US008316760B2

(12) United States Patent
Berthault

(10) Patent No.: US 8,316,760 B2
(45) **Date of Patent: *Nov. 27, 2012**

(54) SINGLE-SERVING DEVICE FOR THE DISPLAY AND COOKING OF IN PARTICULAR KERNELS OF CORN FOR MAKING POPCORN

(76) Inventor: François Berthault, Saint Genis de Saintonge (FR)

( * ) Notice: Subject to any disclaimer, the term of this patent is extended or adjusted under 35 U.S.C. 154(b) by 712 days.

This patent is subject to a terminal disclaimer.

(21) Appl. No.: 12/469,248

(22) Filed: May 20, 2009

(65) Prior Publication Data

US 2009/0277336 A1 Nov. 12, 2009

Related U.S. Application Data

(63) Continuation-in-part of application No. 11/773,598, filed on Jul. 5, 2007, now abandoned, which is a continuation-in-part of application No. 10/530,891, filed as application No. PCT/FR03/50076 on Oct. 3, 2003, now Pat. No. 7,456,376.

(30) Foreign Application Priority Data

Oct. 9, 2002 (FR) ..... 02 12546

(51) Int. Cl.
*H05B 6/80* (2006.01)

(52) U.S. Cl. ..... 99/323.5; 229/108.1; 426/107

(58) Field of Classification Search ..... 99/323.5; 229/101, 108, 108.1, 109, 138, 155, 903; 426/107, 111, 106; 219/727
See application file for complete search history.

(56) References Cited

U.S. PATENT DOCUMENTS

| | | | | |
|---|---|---|---|---|
| 2,791,367 | A * | 5/1957 | Mefford | 229/101 |
| 2,841,319 | A * | 7/1958 | White et al. | 229/120 |
| 4,453,665 | A | 6/1984 | Scott et al. | |
| 5,358,175 | A | 10/1994 | Cai | |
| 5,468,939 | A | 11/1995 | MacLean | |
| 7,456,376 | B2 * | 11/2008 | Berthault | 219/727 |
| 2006/0210676 | A1 * | 9/2006 | Knebl | 426/106 |

FOREIGN PATENT DOCUMENTS

| | | |
|---|---|---|
| DE | 19643837 | 5/1995 |
| EP | 0563442 | 10/1993 |
| FR | 2699150 | 6/1994 |

* cited by examiner

*Primary Examiner* — Vishu K. Mendiratta
(74) *Attorney, Agent, or Firm* — Young & Thompson

(57) ABSTRACT

A device for displaying and cooking food such as kernels of corn includes a container with a base that can store kernels of corn extended by a compensation zone that can assume at least two positions, one folded and the other unfolded. The compensation zone includes four faces: two retractable faces and two stiffening faces opposite, whereby the retractable faces each include a fold that is approximately at the center of each of these faces and parallel to the base. The stiffening faces each include a first fold that is approximately at the center of each of these faces and parallel to the base and diagonal folds, whereby the base is rigid over a height so as to delimit a restricted space in which kernels of corn are likely to be stored when the compensation zone is in the folded position.

7 Claims, 19 Drawing Sheets

Figure 1A:
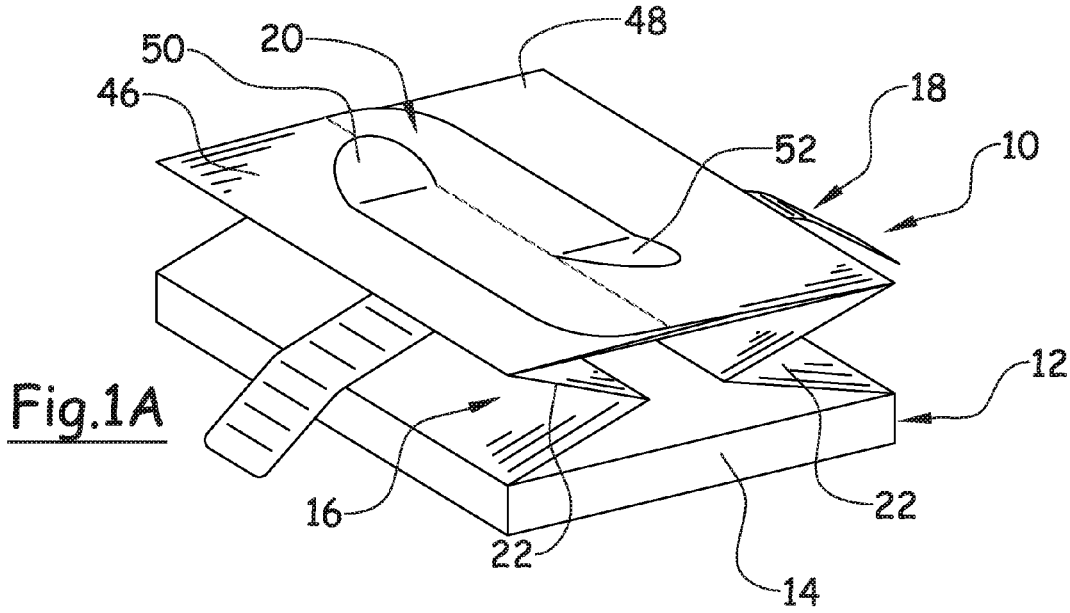

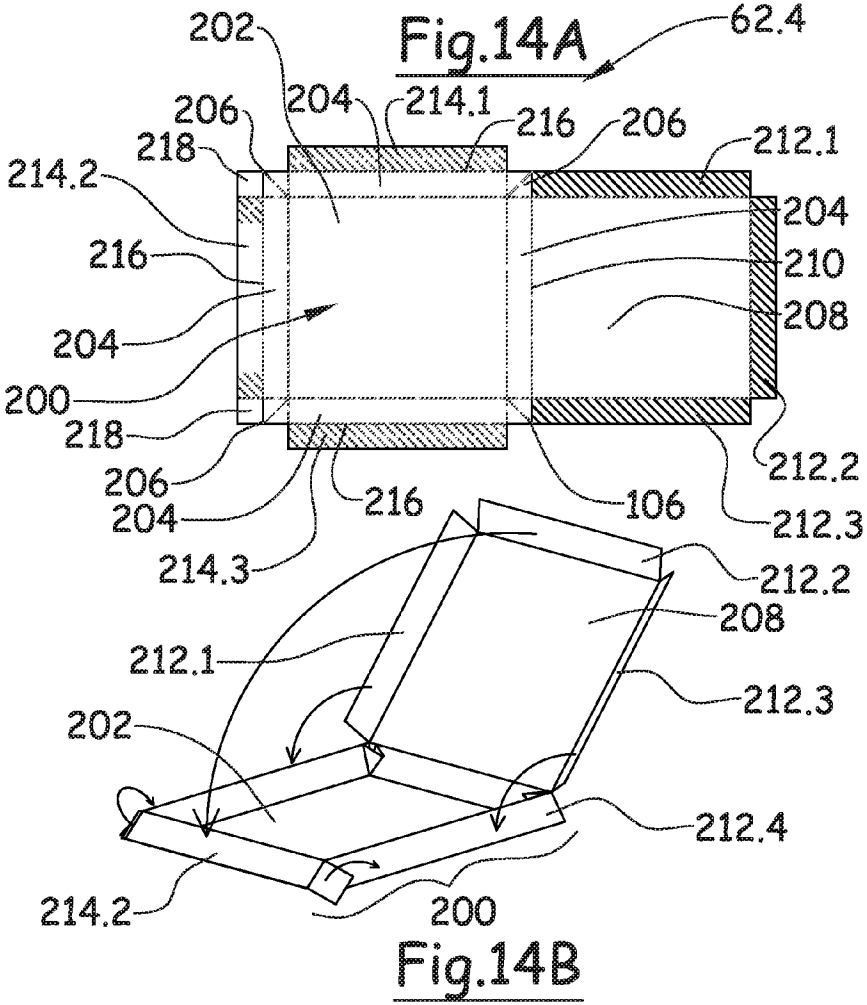
Fig.14A
Fig.14B
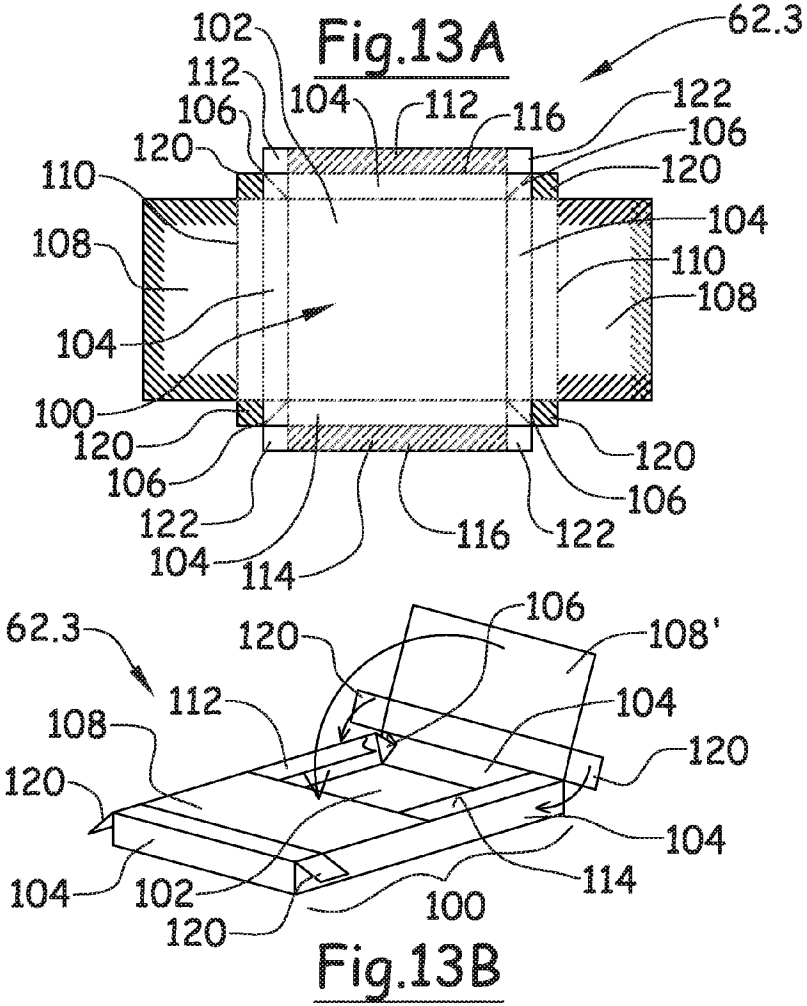
Fig.13A
Fig.13B

SINGLE-SERVING DEVICE FOR THE DISPLAY AND COOKING OF IN PARTICULAR KERNELS OF CORN FOR MAKING POPCORN

This application is a continuation-in-part of co-pending application Ser. No. 11/773,598 filed on Jul. 5, 2007; which is a continuation-in-part of application Ser. No. 10/530,891 filed on Apr. 11, 2005, which is the 35 U.S.C. 371 national stage of international application PCT/FR2003/050076 filed on Oct. 3, 2003; which claimed priority to French application 02 12546 filed Oct. 9, 2002. The entire contents of each of the above-identified applications are hereby incorporated by reference.

This invention relates to a single-serving device for the display and cooking of in particular kernels of corn for making popcorn.

This invention is described with regard to a well-known product, popcorn, but it is possible to consider other applications, in particular appetizers such as snacks of any kind, balls, fried or made from corn semolina converted into semolina and compressed and prepared in a suitable way.

For reasons of simplifying the explanation and taking into account the fact that the device is in all cases used in a totally identical way, the description is given for the natural corn kernel and the production of popcorn.

It has been known for a long time that corn kernels, when heated, burst by forming a white corolla, whereby the product is referred to as popcorn.

These kernels of corn should be placed in a container in the presence of grease.

With the invention of the microwave oven, however, the manufacturers proposed corn kernels packaged in bags with grease immobilizing the corn kernels under cold conditions because the grease congeals.

Actually, to ensure an efficient popping that is as complete as possible, it was preferable that the corn kernels remain pressed against one another. Radiation was then concentrated, and efficiency was increased.

The corn kernels themselves are different only in that they are used with thermal heating or with microwave heating. There is no need for a special prior treatment. The water that is contained in the kernels that is converted into vapor causes the explosion of the kernel shell and the formation of popcorn.

In the case of these flexible packages, the bag is made of a material that is suitable for letting microwaves pass through without being degraded under their effects, and this bag is also used as a container. More precisely, the complex comprises at least one microwave-reactive layer that transmits a portion of the microwaves, absorbs another portion of them for conversion into infrared radiation and in contrast reflects the infrared thus produced to reconstitute the heating conditions that are adequate for causing the kernels to pop.

In contrast, after cooking, the bag remains very hot because of the very small thickness of the package and the heat that is generated.

Once the kernels have popped, in the case of sweetened popcorn if it is desired to convert the sugars and obtain the organoleptic properties produced by the Maillard reactions that provide the taste of caramel from sugar, it is necessary to reach an adequate temperature, which makes such a package difficult to create.

More particularly, a product of this type is known under the name Crousti Pack.

For the consumer, it takes only placing the package in the microwave oven, putting the latter into operation for the recommended period, and taking out the container with its popcorn ready to be eaten.

It is the swelling of the popcorn and the generation of steam with the expansion of the contained air that ensure the swelling and the unfolding of the bag that initially contains the corn kernels.

Since then, it is known that microwave ovens have been improved and that the radiation is homogeneous and that it is no longer necessary to pack the kernels against one another.

In contrast, there exists a problem that relates to the display because once unfolded, the bag that is made of a complex of plastic and/or paper films does not have any stability and it cannot be used as a display container. As indicated above, the bag remains extremely hot after the popcorn is produced.

In contrast, it is also understood that the initial package should of necessity be folded to reduce its volume. The kernels could move in a container that was much too large before cooking, which is not desirable and, moreover, it is not possible to transport packages that are 9/10 empty. It is necessary that they be folded.

A foldable box for cooking popcorn is described in the document U.S. Pat. No. 5,468,938. This parallelepipedic box comprises side walls with automatic assembly flaps. In flat position, the rear and front faces are flattened against the bottom and top faces. To form the box, it takes only pushing the opposing edges toward one another. The corn kernels are packaged in a bag that can be introduced into the box.

This solution is not satisfactory because the bag is not immobilized in the folded box and prevents a complete folding of the box.

Also, this invention proposes a new device that makes it possible to use and to preserve corn kernels, to carry out the popping of these kernels in a microwave oven and to display the popcorn that is produced.

According to one objective of the invention, the device should be simple to use and should in particular make it possible to monitor the cooking of the popcorn well.

Figure 1B:
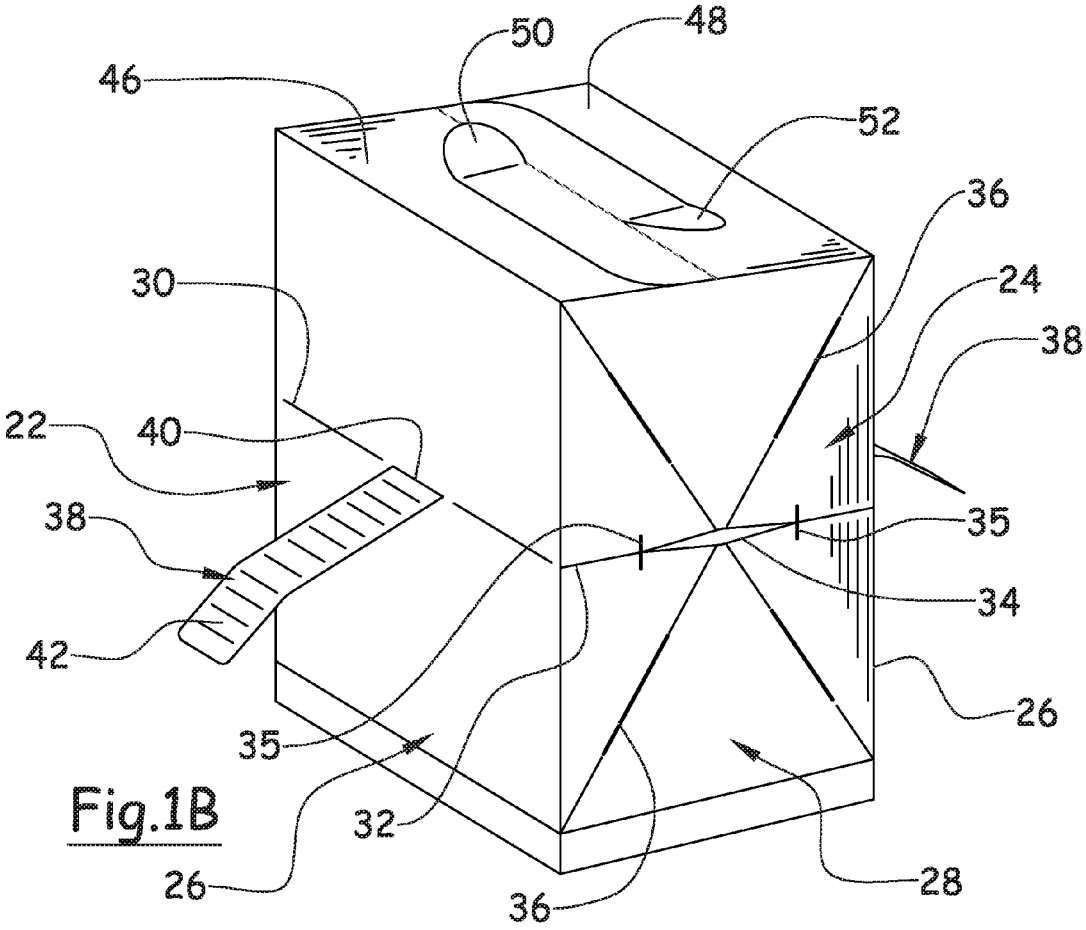
Figure 2:
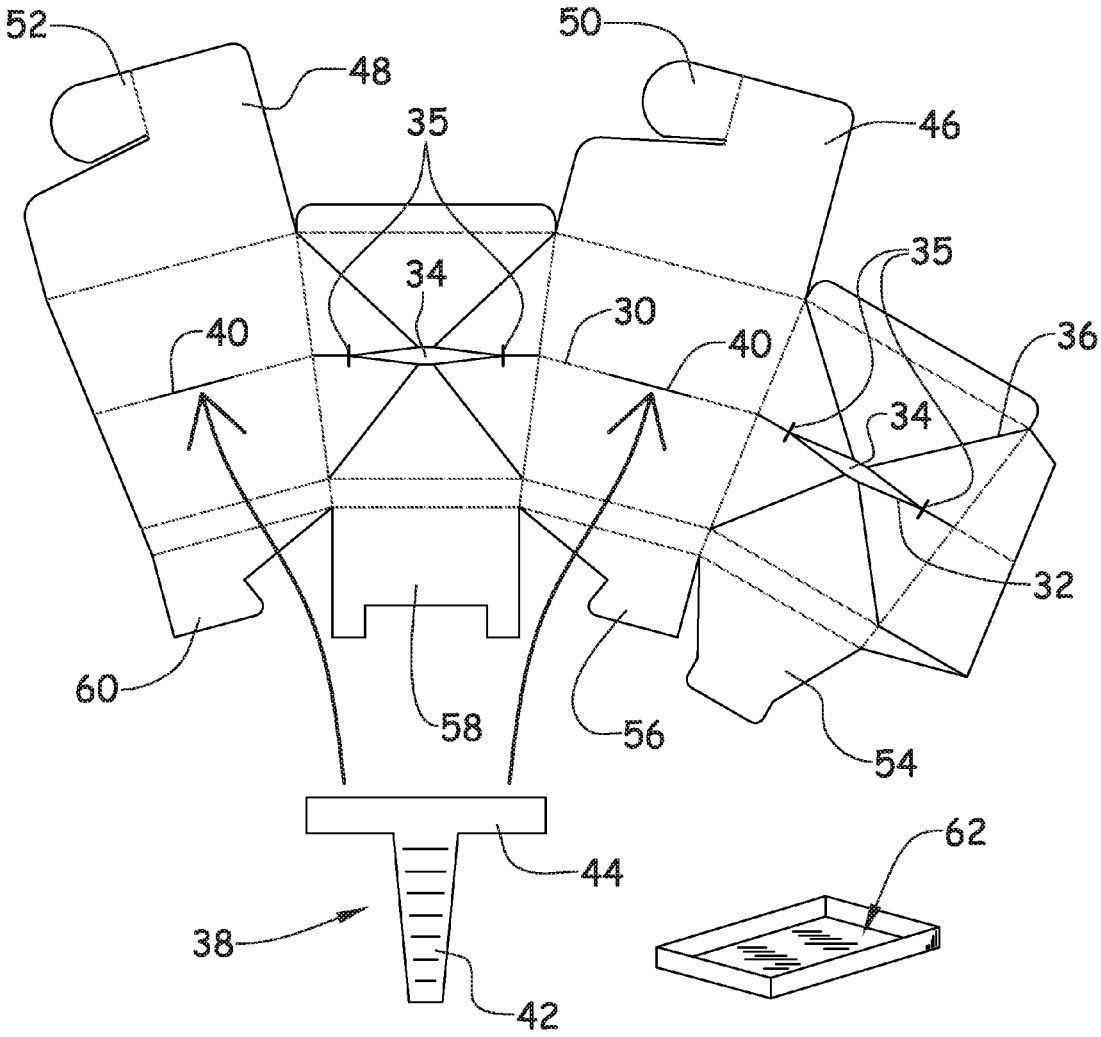
Figure 3:
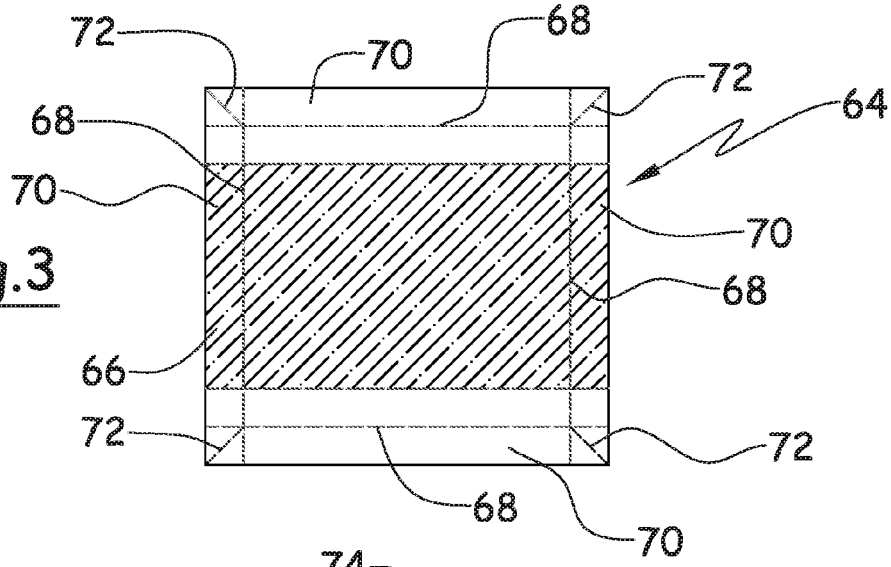
Figure 4:
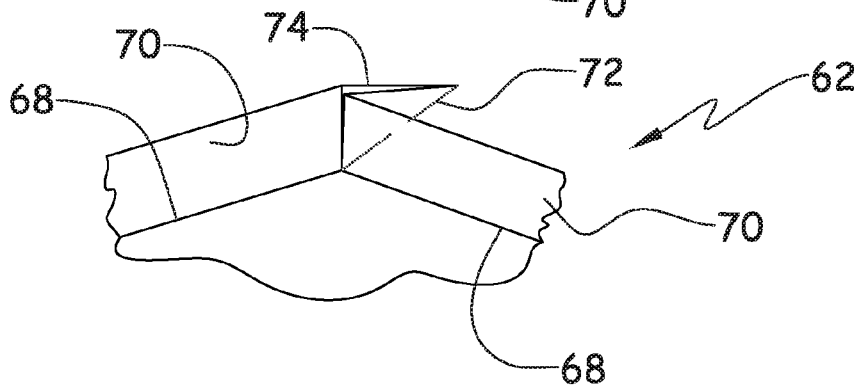
Figure 5:
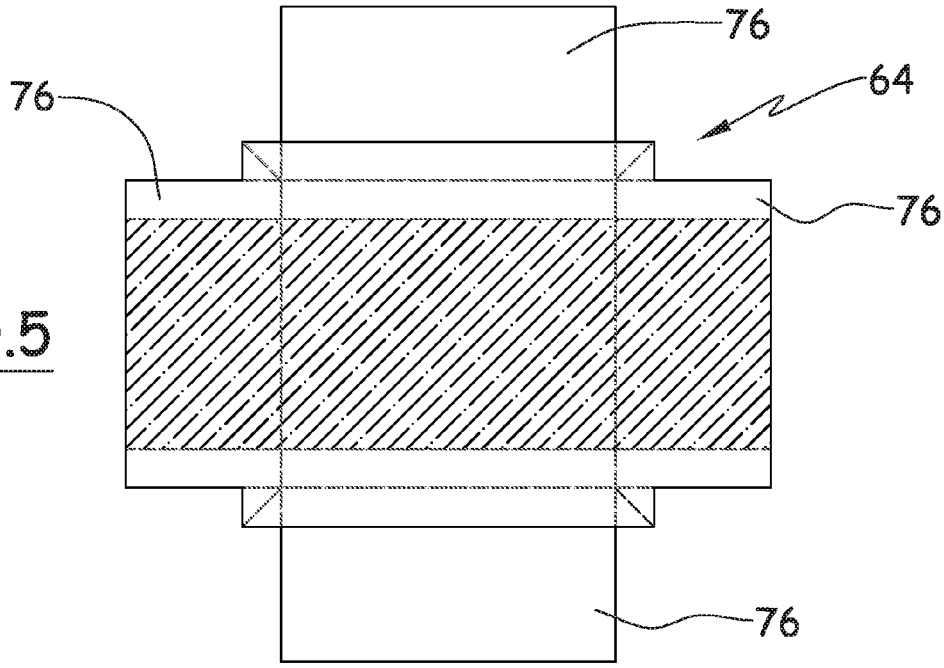
Figure 6A:
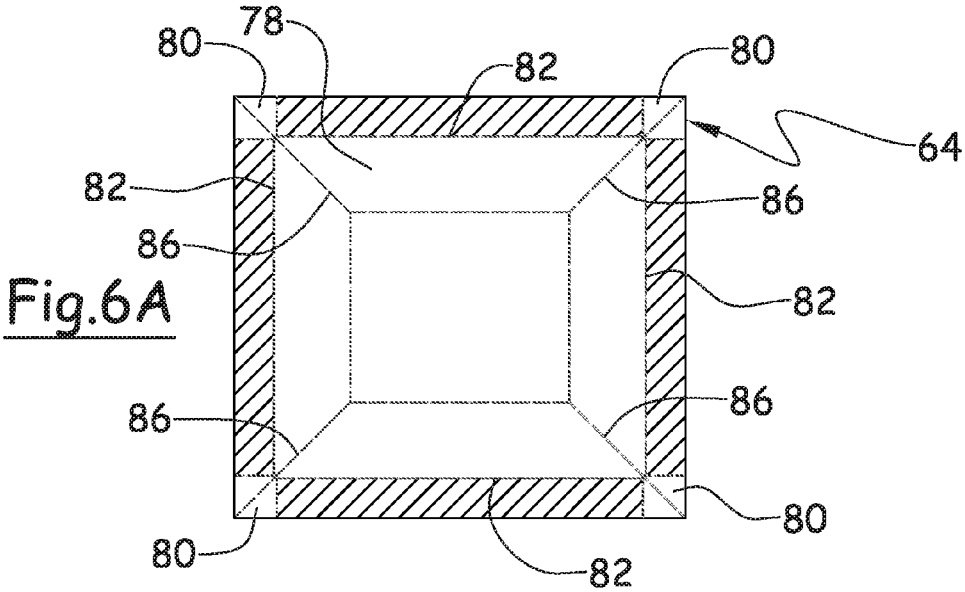
Figure 6B:
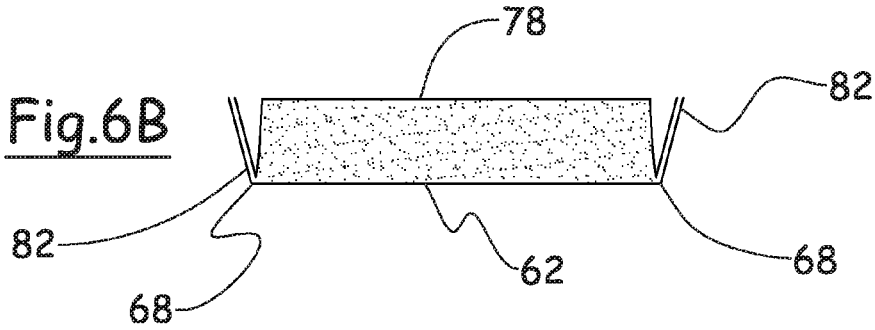
Figure 7A:
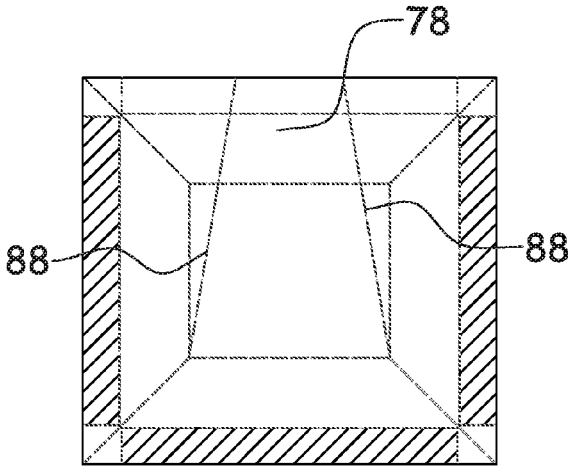
Figure 7B:
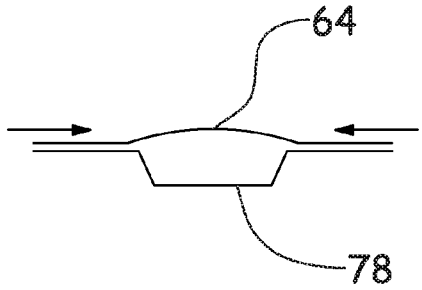
Figure 8A:
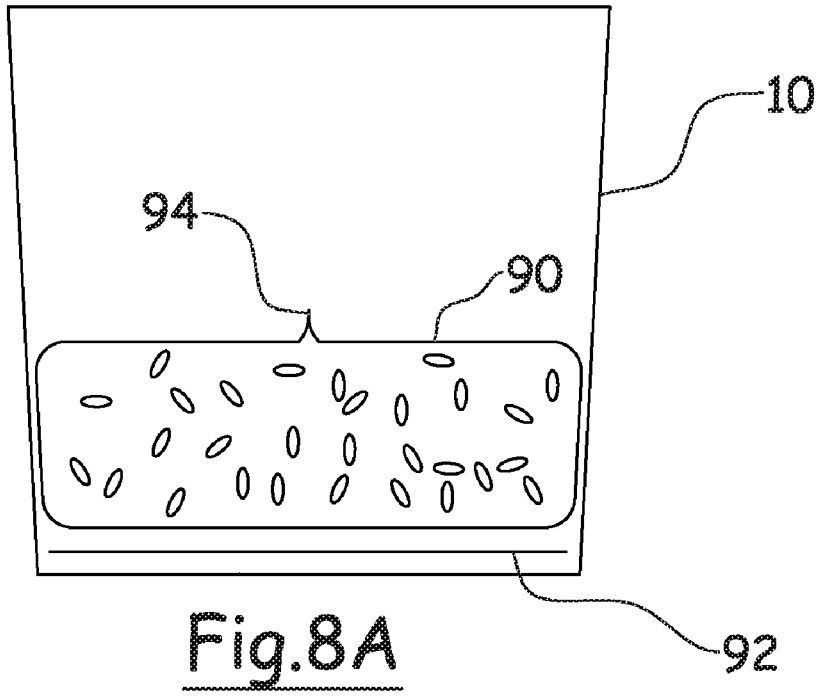
Figure 8B:
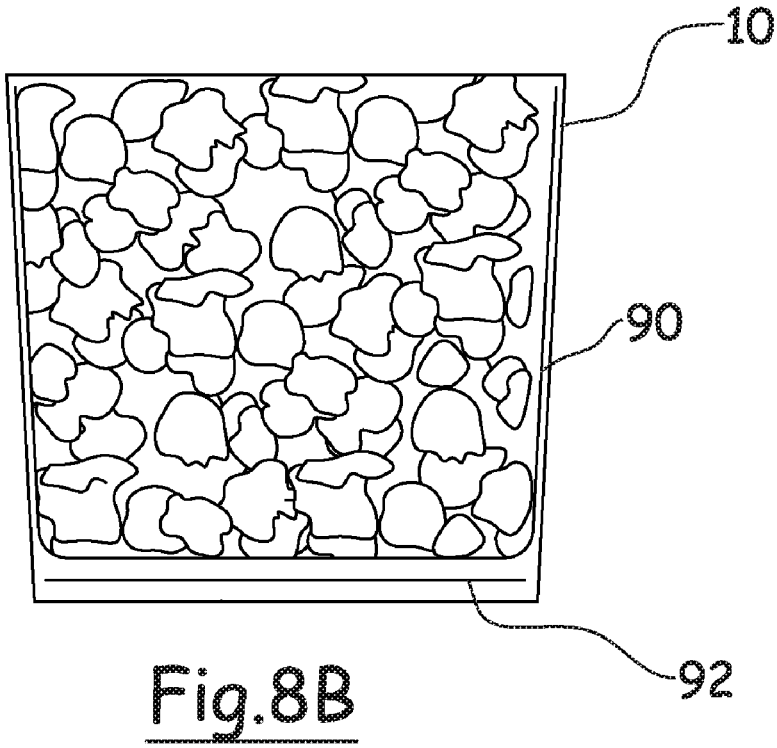
Figure 9A:
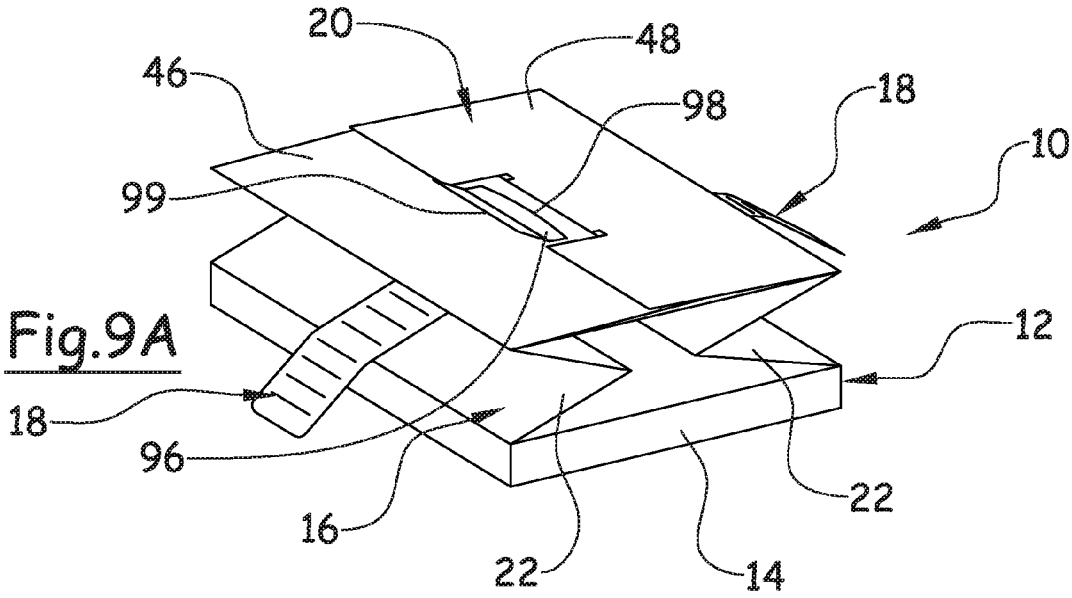
Figure 9B:
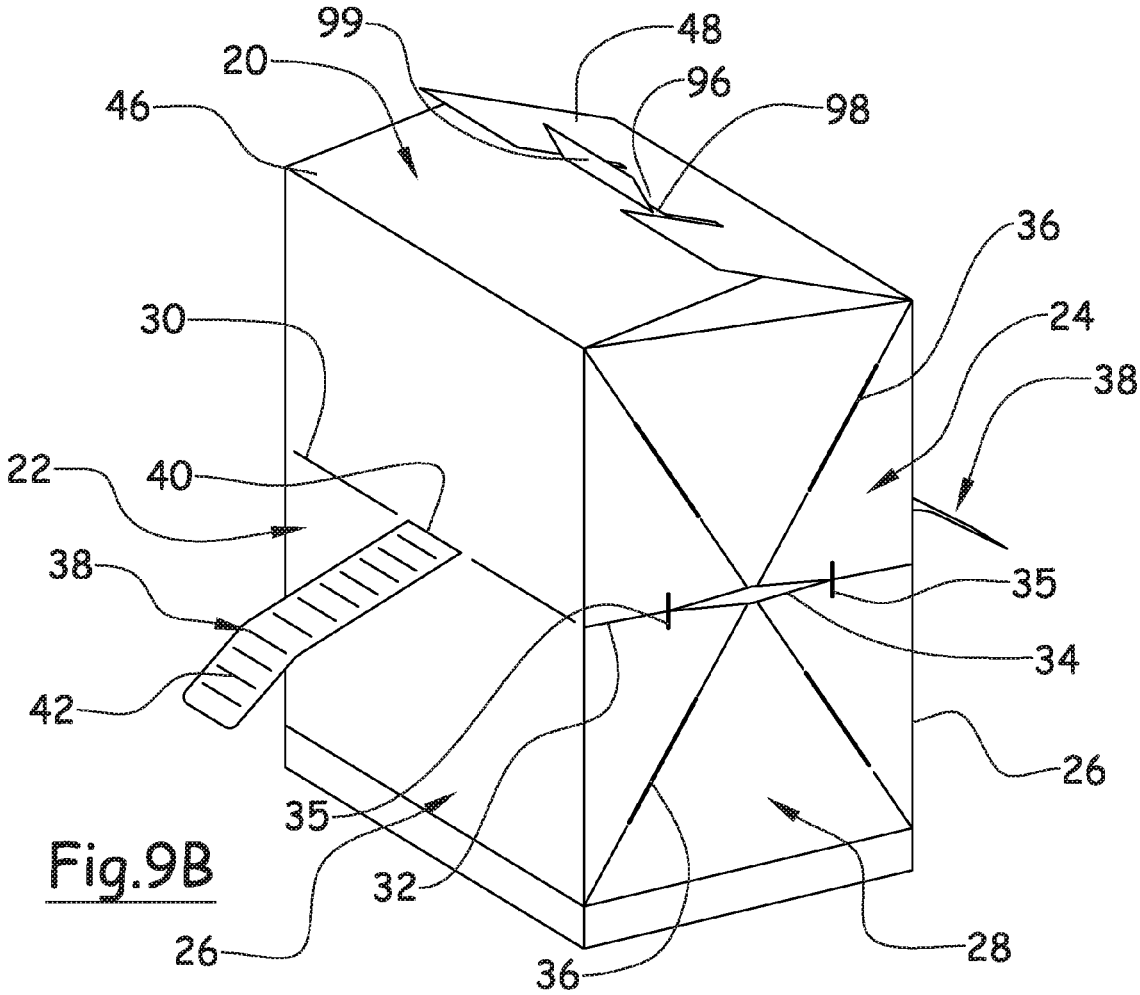
Figure 10:
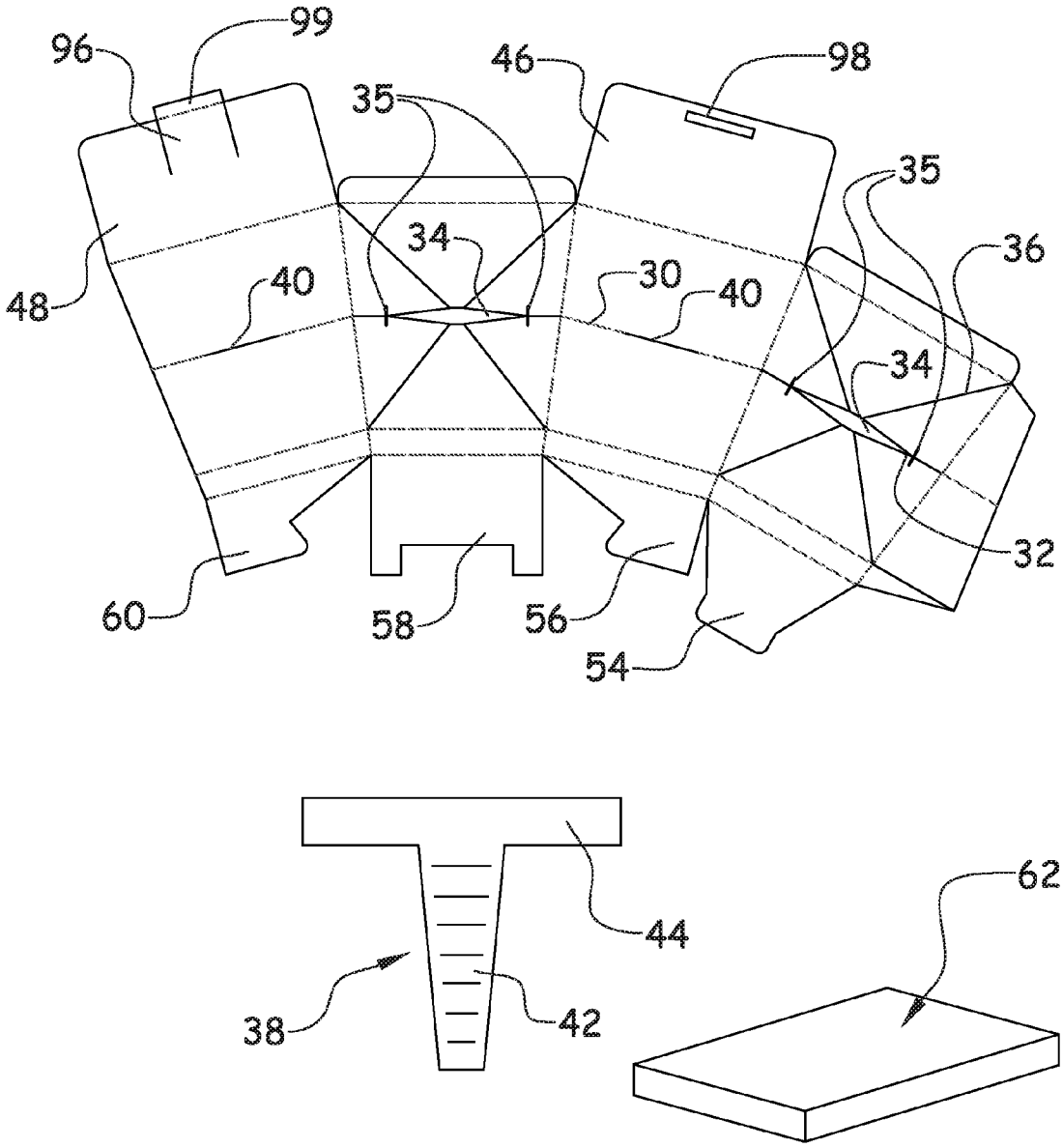
Figure 11A:
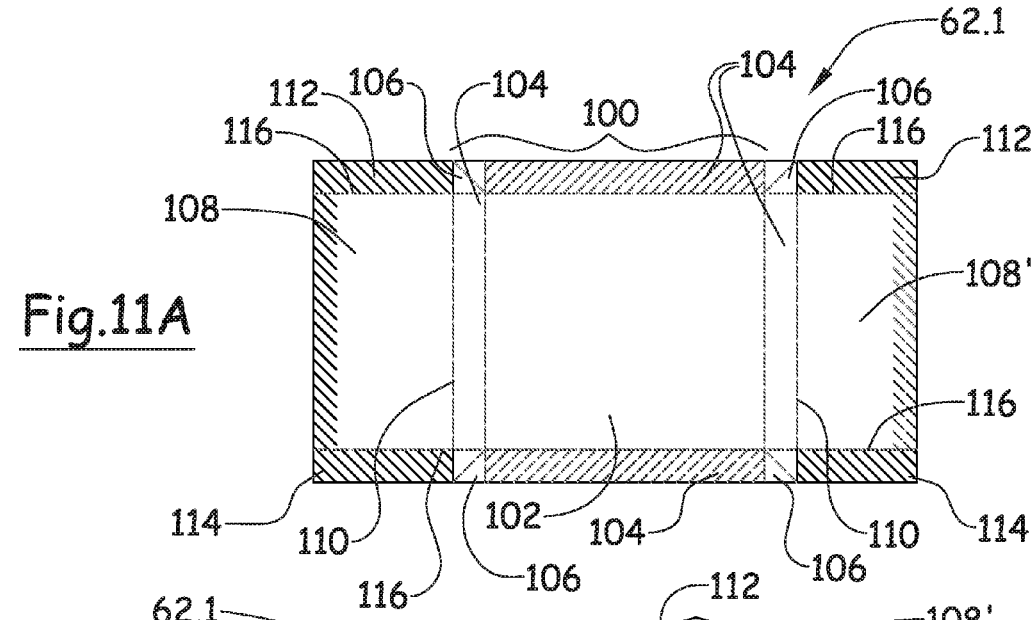
Figure 11B:
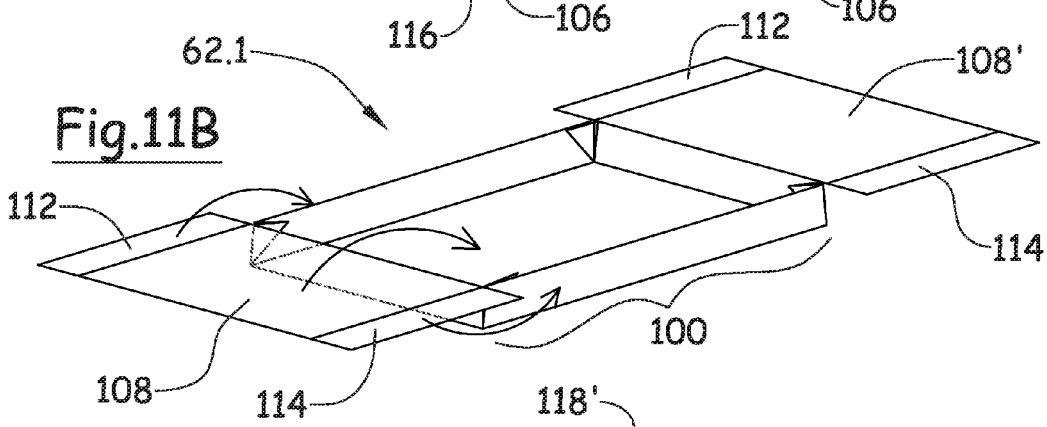
Figure 11C:
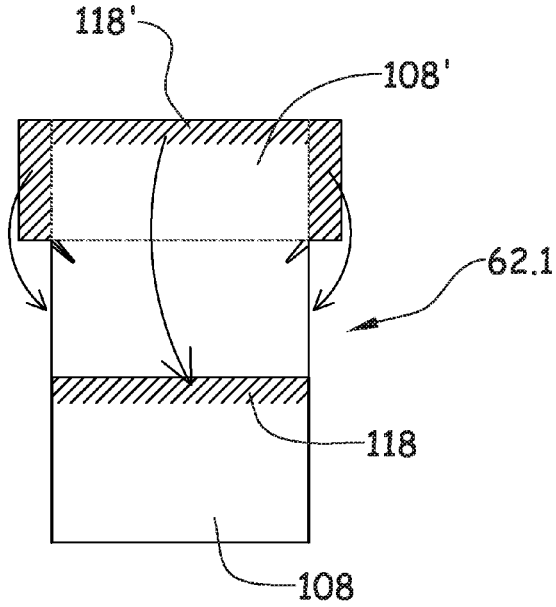
Figure 12A:
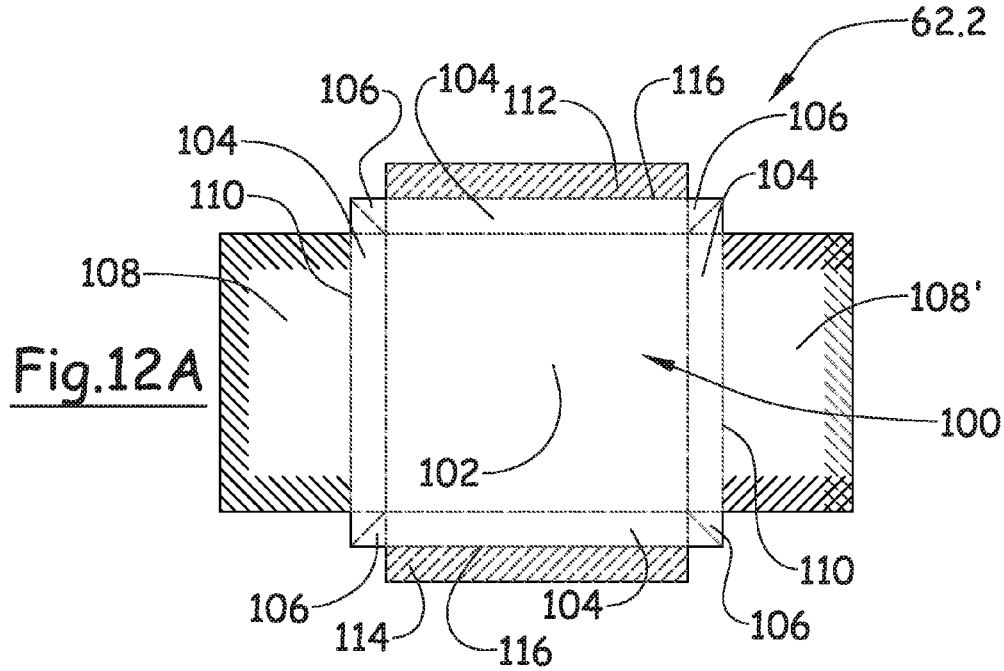
Figure 12B:
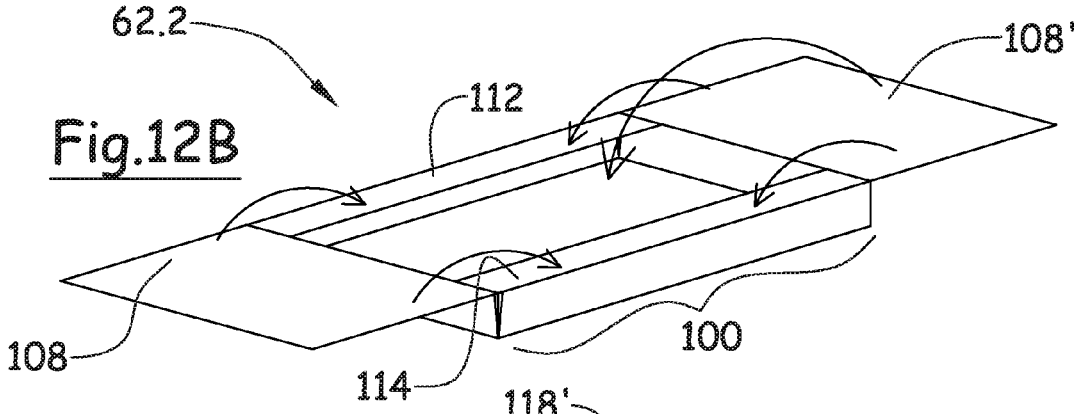
Figure 12C:
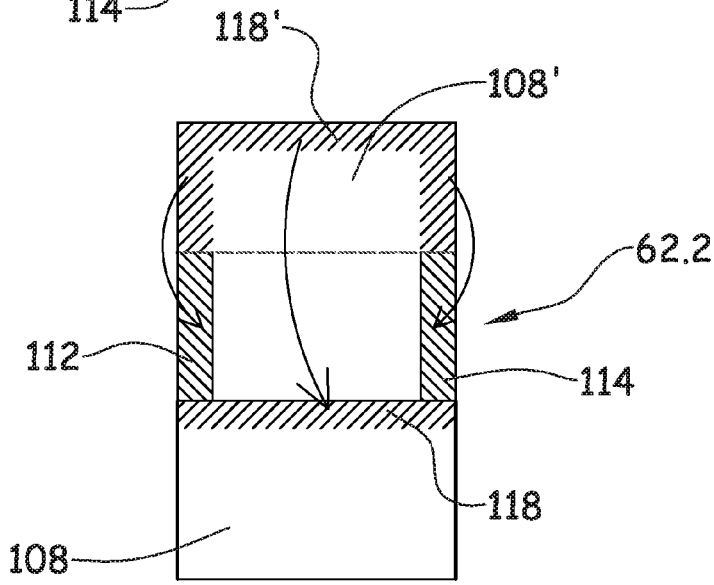
Figure 15A:
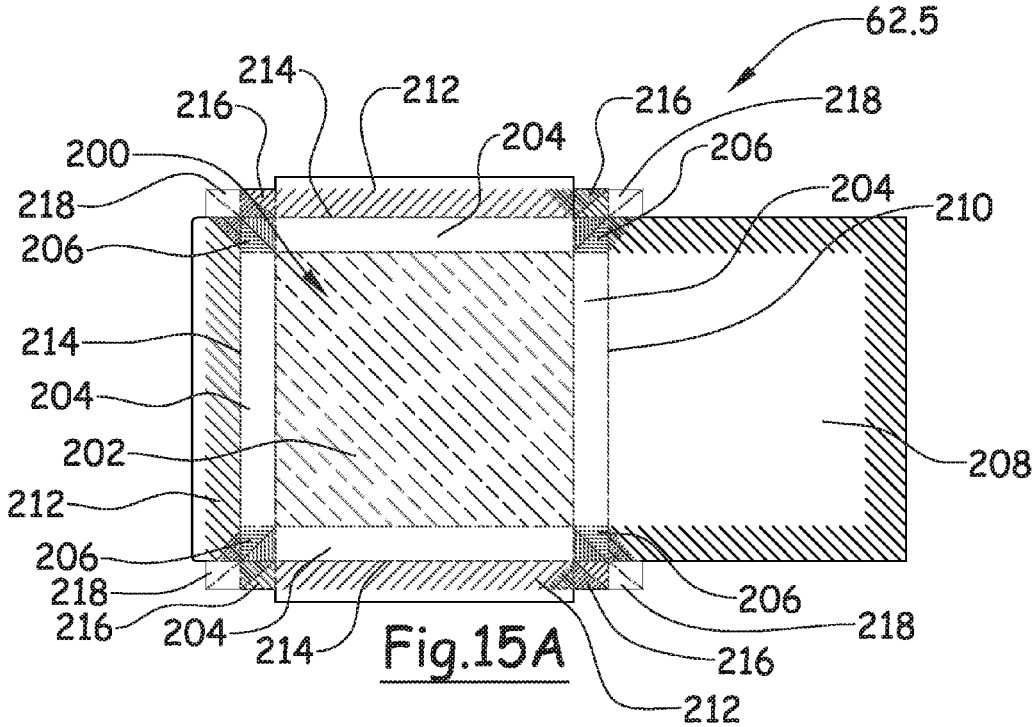
Figure 15C:
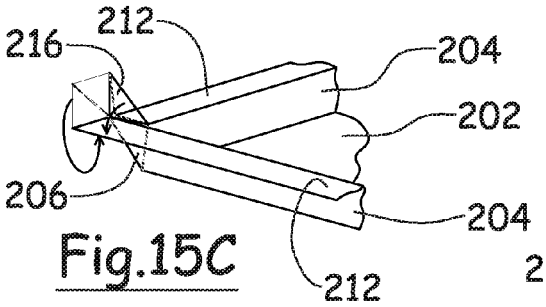
Figure 15B:
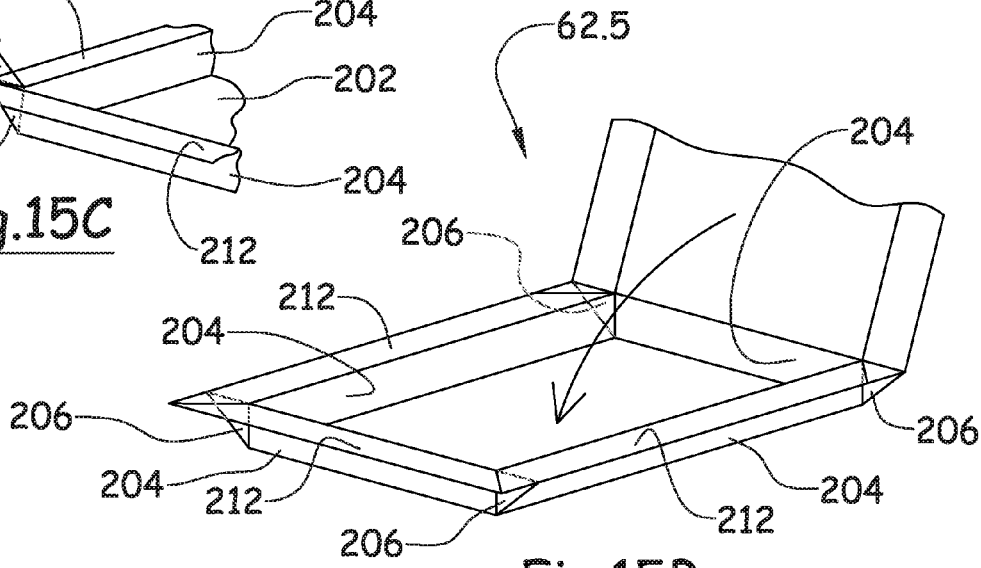
Figure 16:
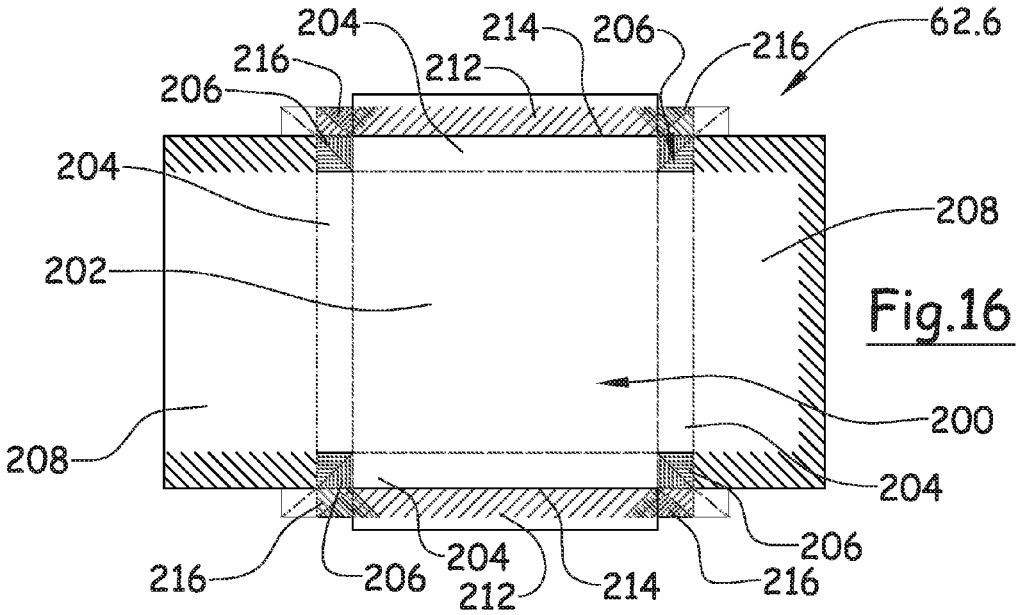
Figure 17A:
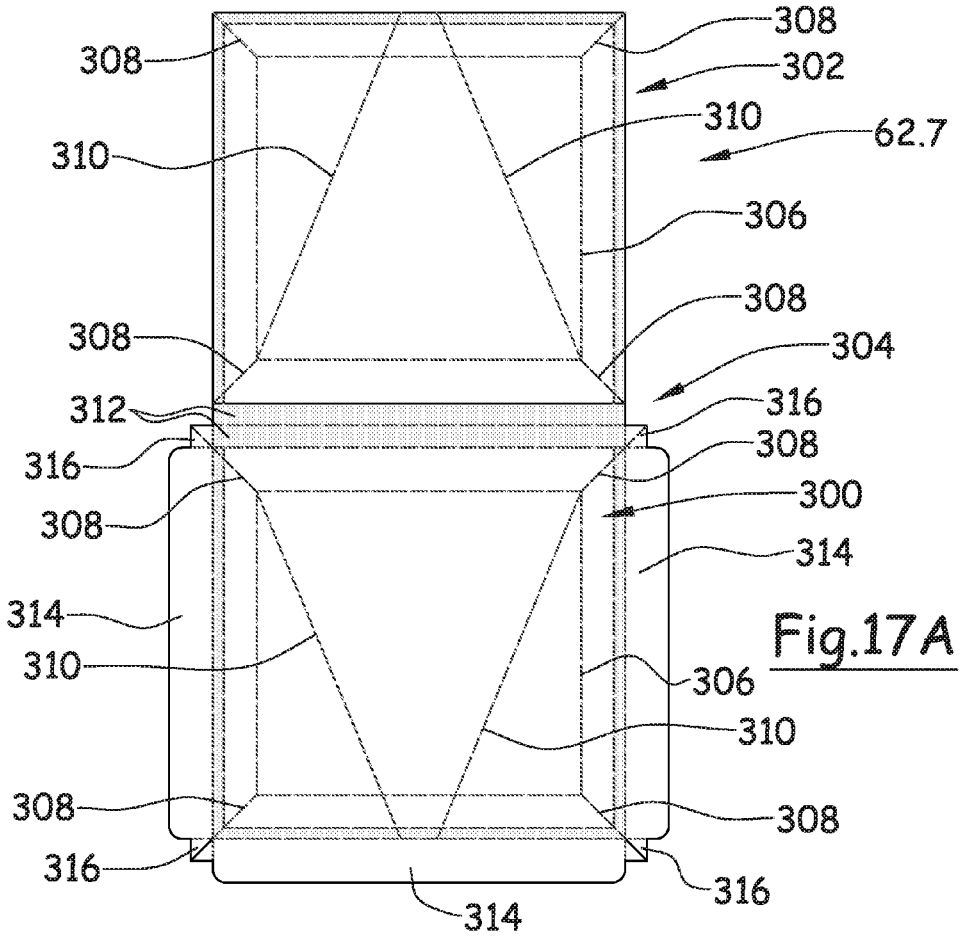
Figure 17B:
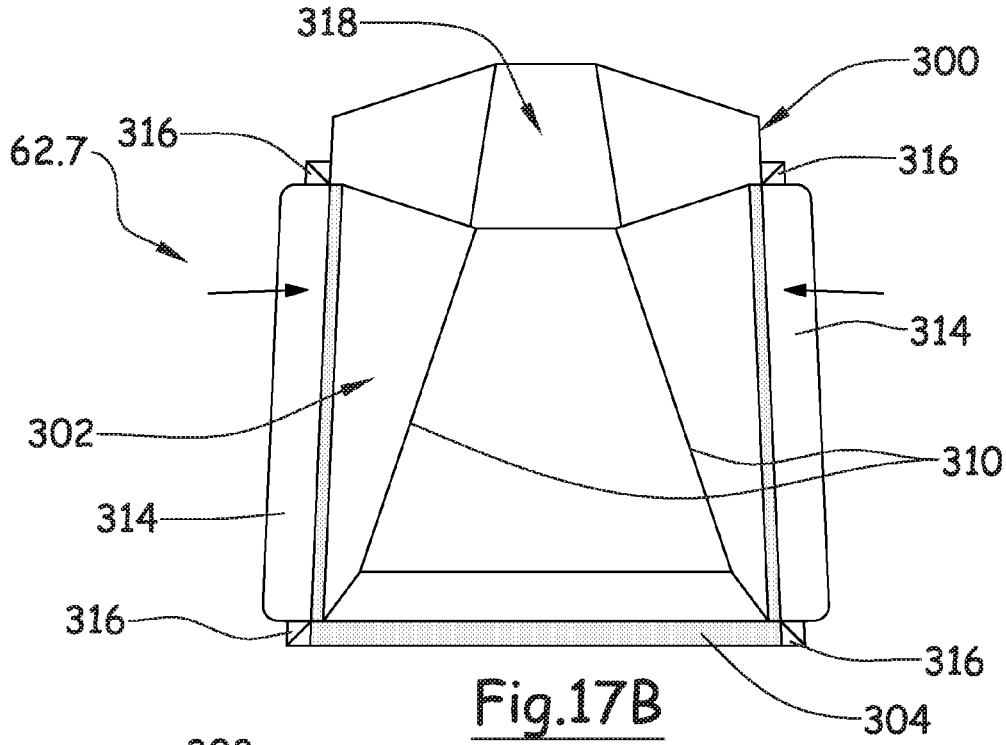
Figure 17C:
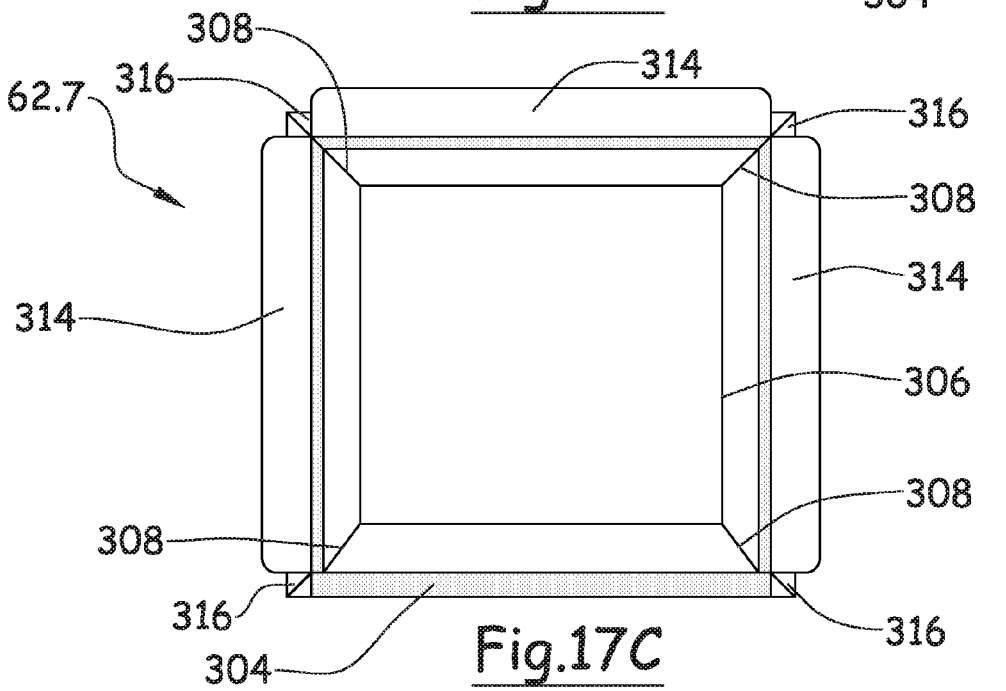
Figure 17D:
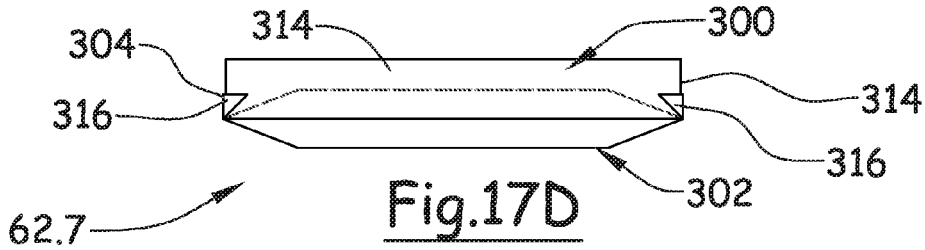
Figure 18:
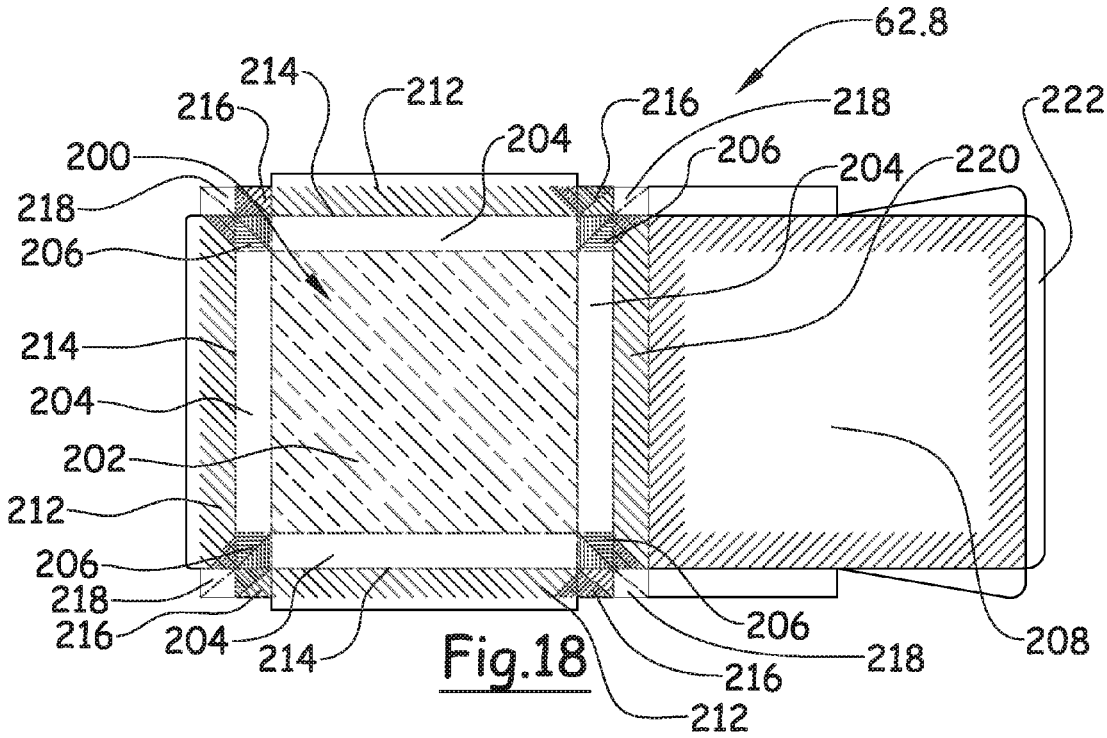
Figure 19A:
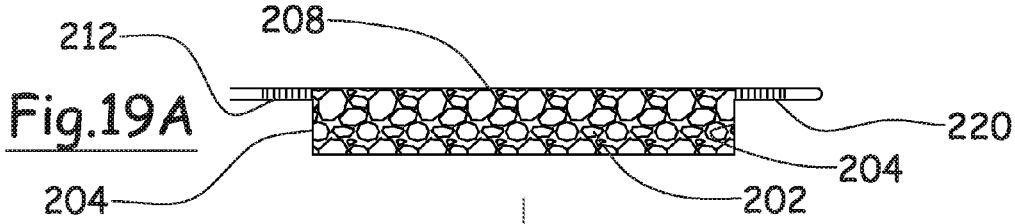
Figure 19B:
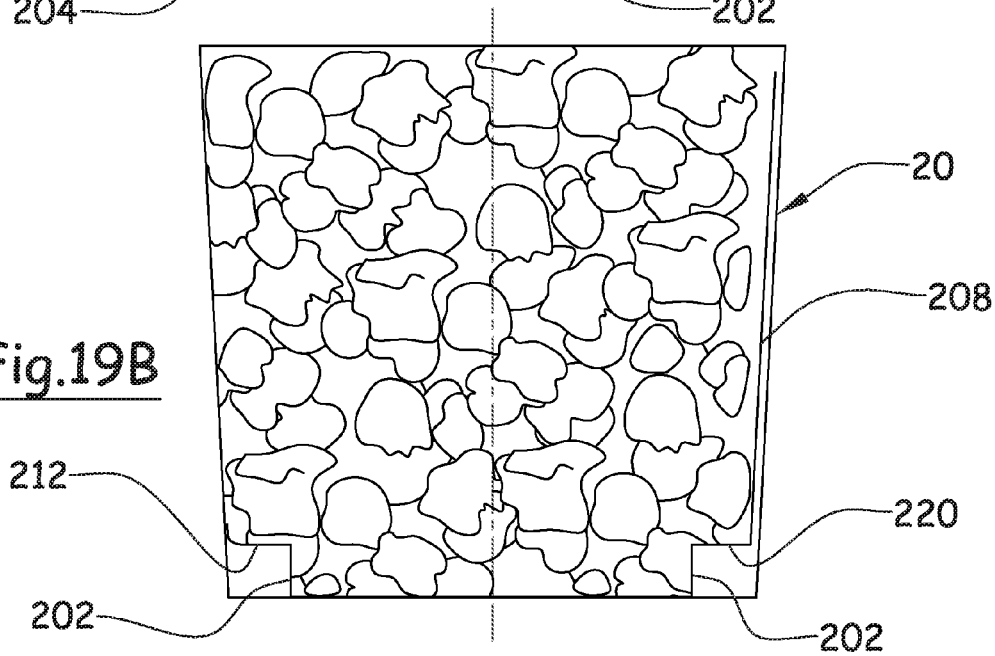
Figure 20:
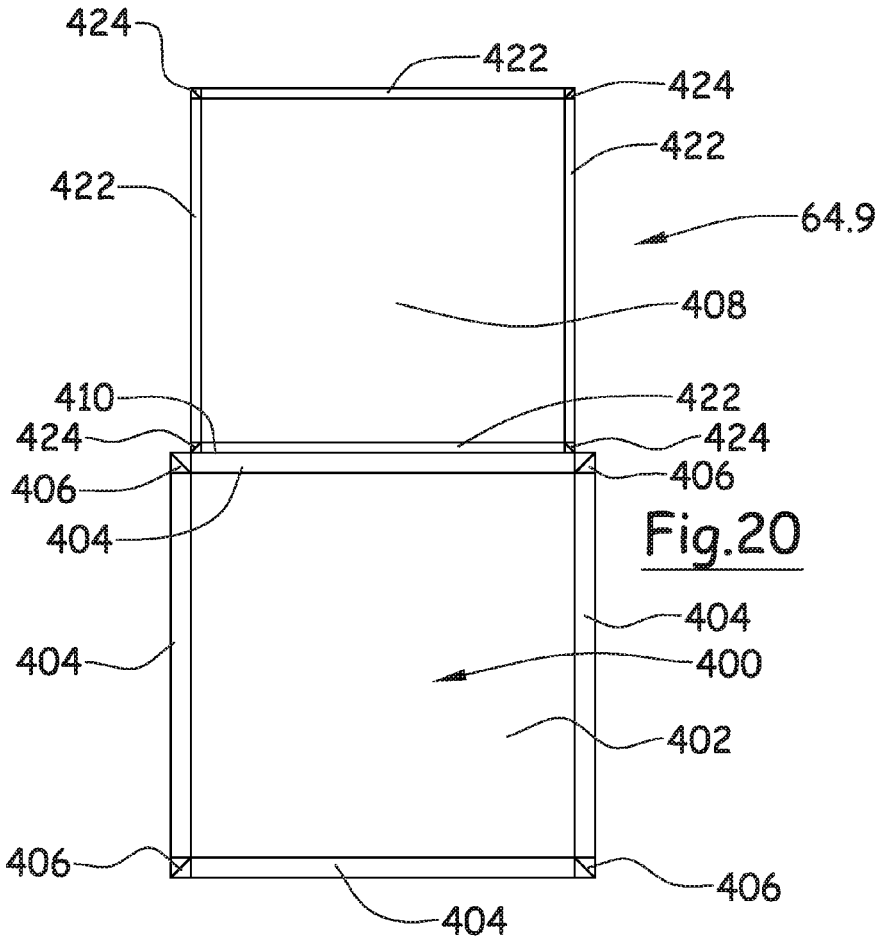
Figure 21A:
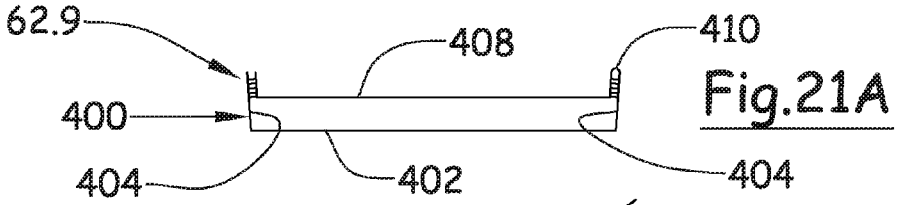
Figure 21B:
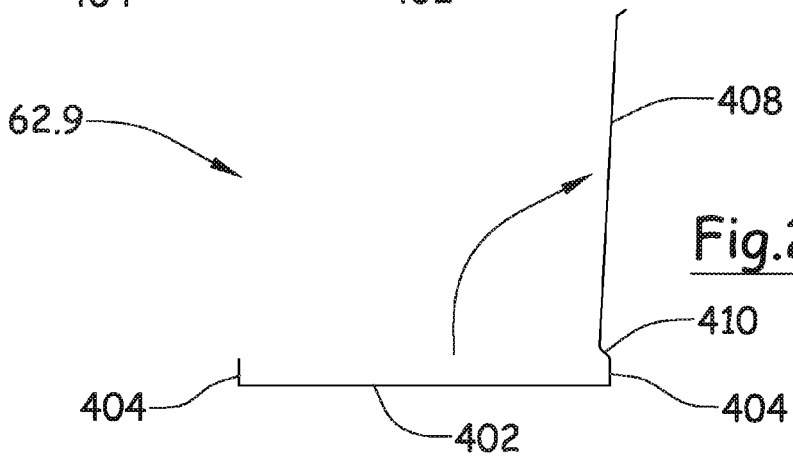
Figure 22:
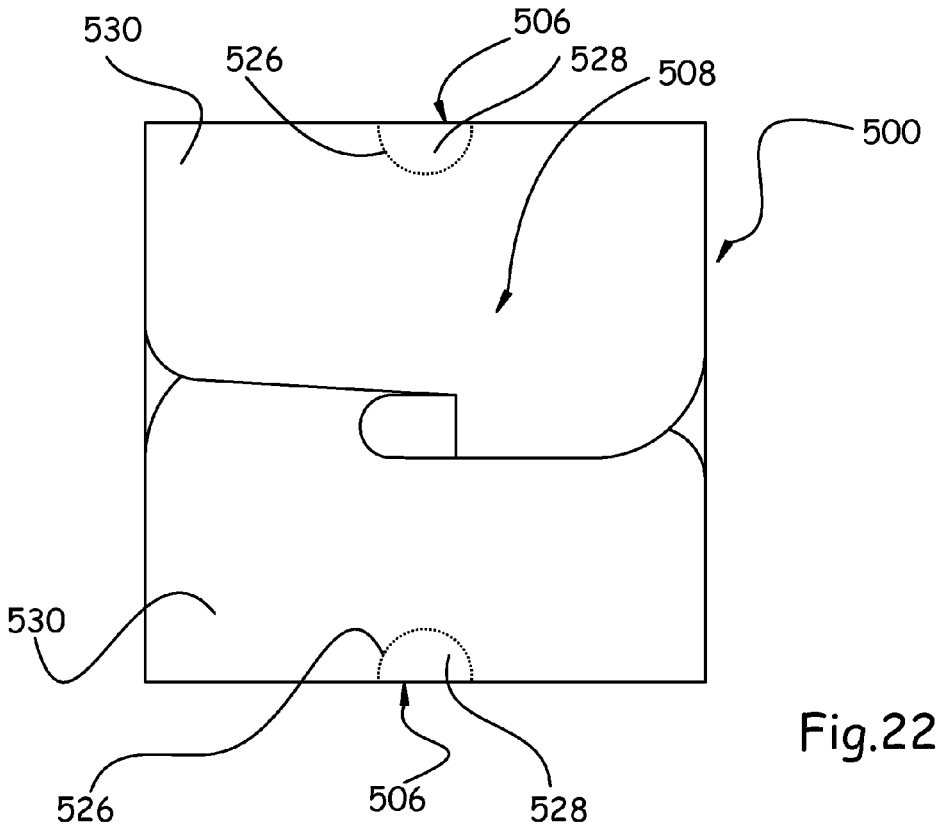
Figure 23:
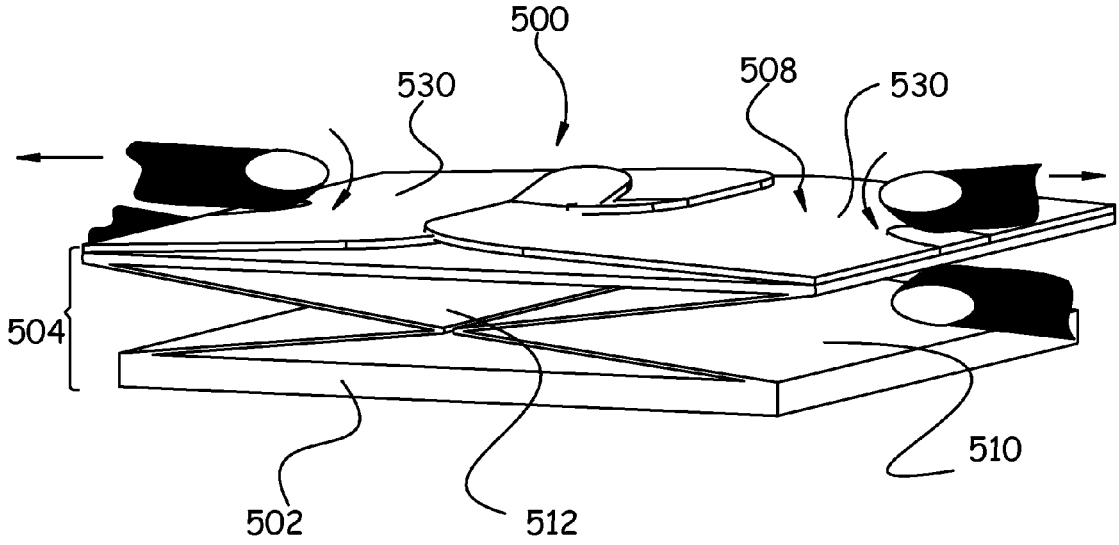
Figure 24:
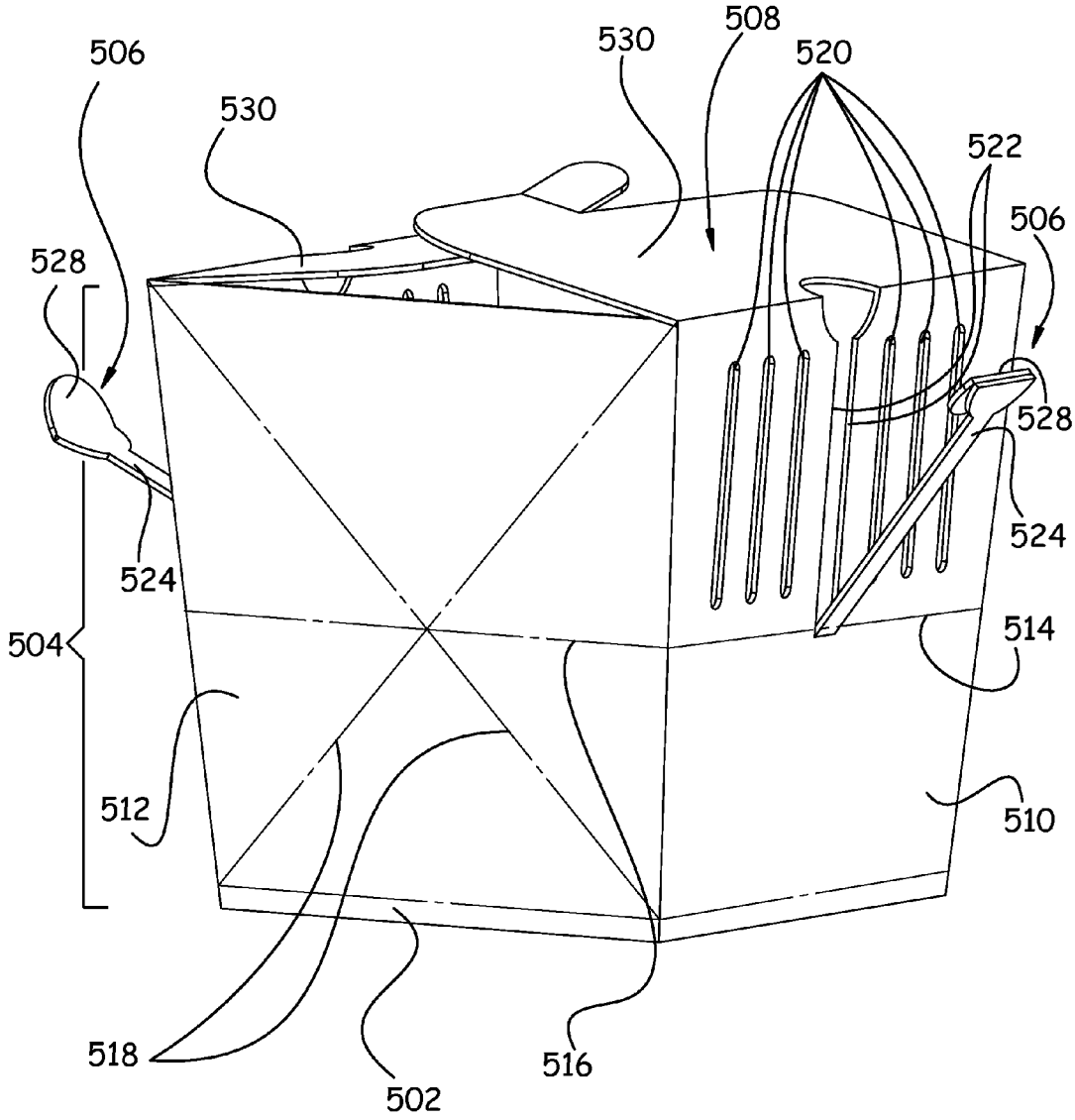
Figure 25:
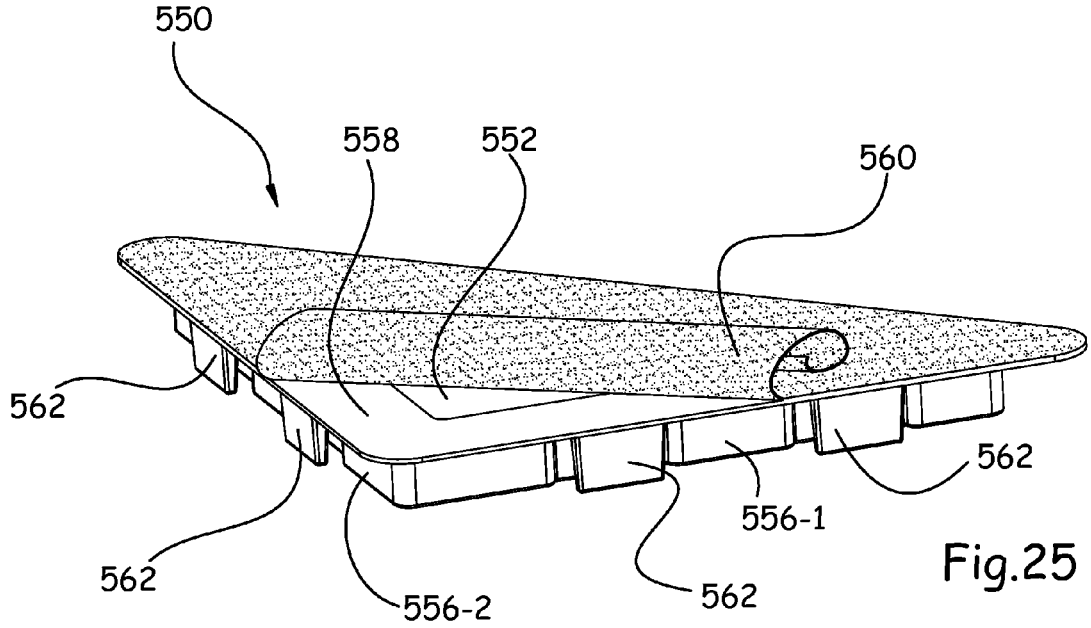
Figure 26:
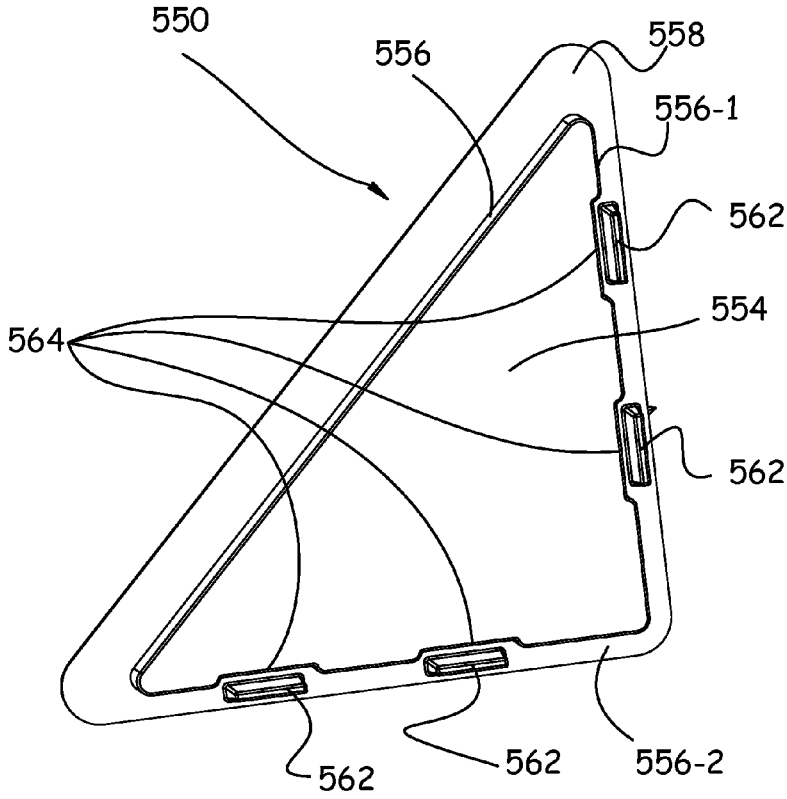
Figure 27:
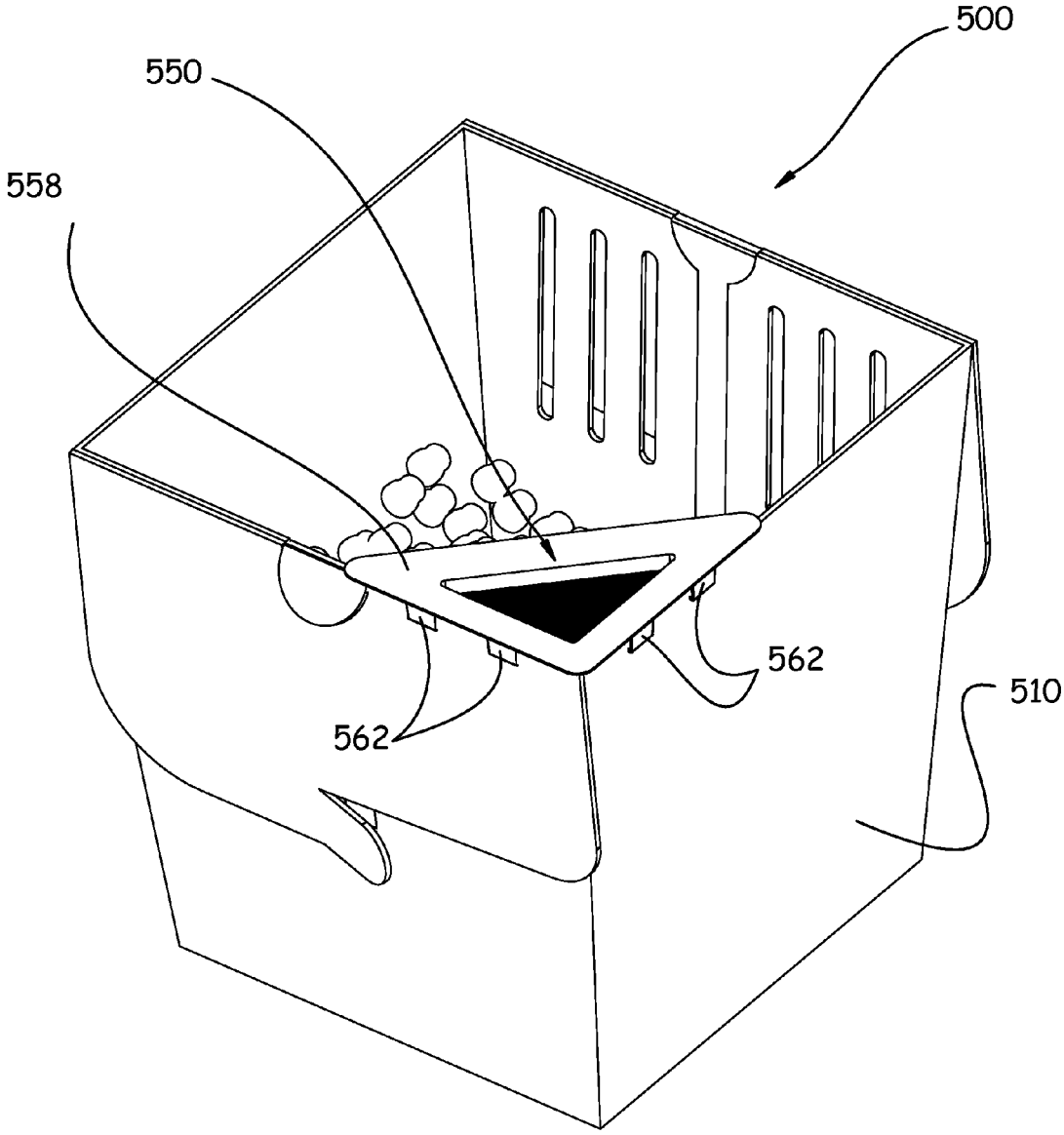

This invention is described in detail with regard to the accompanying drawings that show a preferred but nonlimiting embodiment, whereby the figures correspond to FIG. 1A, a view of the device for the display and cooking of kernels of corn according to this invention, in the folded position, FIG. 1B, a view of this same device after unfolding, ready for cooking, FIG. 2, a view of the mold making it possible to produce such a device, FIG. 3, a view illustrating an embodiment of a mold that forms the tub, FIG. 4, a perspective view in detail of an angle of a tub, FIG. 5, a view illustrating another embodiment of a mold, FIG. 6A, a view that provides a flat illustration of a tub with a cover according to a first embodiment, FIG. 6B, a section showing the tub of FIG. 6A that is formed, FIG. 7A, a view that provides a flat illustration of a tub with a cover according to another embodiment that makes it easy to fill, FIG. 7B, a top view that shows the tub of FIG. 7B in filling position, FIGS. 8A and 8B, sections of another method of packaging kernels of corn before and after cooking, FIG. 9A, a view of the device for the display and cooking of kernels of corn according to this invention, in the folded position, FIG. 9B, a view of this same device after unfolding, ready for cooking, FIG. 10, a view of the mold making it possible to produce such a device, FIG. 11A, a view of a mold illustrating a first embodiment of a small container, FIG. 11B, a perspective view of the small container of FIG. 11A during folding, FIG. 11C, a side view illustrating the small container of FIG. 11A before filling, FIG. 12A, a view of a mold illustrating a second embodiment of a small container, FIG. 12B, a perspective view of the small container of FIG. 12A during folding, FIG. 12C, a side view illustrating the small container of FIG. 12A before filling, FIG. 13A, a view of a mold illustrating a third embodiment of a small container, FIG. 13B, a perspective view illustrating the small container of FIG. 13A during folding, FIG. 14A, a view of a mold illustrating a fourth embodiment of a small container, FIG. 14B, a perspective view illustrating the small container of FIG. 14A during folding, FIG. 15A, a view of a mold illustrating a fifth embodiment of a small container, FIG. 15B, a perspective view illustrating the small container of FIG. 15A before filling, FIG. 15C, a detail view illustrating in perspective an angle of the small container of FIG. 15B, FIG. 16, a view of a mold illustrating a sixth embodiment of a container, FIG. 17A, a view of a mold illustrating a seventh embodiment of a small container, FIG. 17B, a perspective view illustrating the small container of FIG. 17A before filling, FIG. 17C, a perspective view illustrating the small container of FIG. 17A after filling, FIG. 17D, a side view of the small container of FIG. 17A that is ready to be used in a first container, FIG. 18, a view of a mold illustrating an eighth embodiment of a small container, FIG. 19A, a section illustrating the small container of FIG. 18 in closed position, FIG. 19B, a section illustrating the small container of FIG. 18 in open position in a first container, FIG. 20, a view of a mold illustrating a ninth embodiment of a small container, FIG. 21A, a section illustrating the small container of FIG. 20 in closed position, FIG. 21B, a section illustrating the small container of FIG. 20 in open position, FIG. 22 is a top view of a variant of the invention, FIG. 23 is a perspective view of the variant that is illustrated in FIG. 22 during unfolding, FIG. 24 is a perspective view of the variant that is illustrated in FIG. 22 in the unfolded state, FIG. 25 is a perspective view of a small sauce container that can be added to a device for the display and cooking of kernels of corn according to the invention, FIG. 26 is a bottom view of the small sauce container that is illustrated in FIG. 25, and FIG. 27 is a perspective view of a device according to the invention to which a small sauce container is added.

In FIG. 1A, the device 10 comprises a container 12 with a base 14, a compensation zone 16, unfolding means 18, and means 20 for opening/closing this container.

The unit is preferably made from a cardboard-type material, more particularly a virgin-wood-fiber cardboard to preserve food quality.

The base is rectangular or square in shape and rigid and is on the order of 1 to 2 centimeters high to set forth the concept.

This base is intended to accommodate the raw corn kernels. The volume of kernels determines the amount of popcorn that will be produced. Nevertheless, it is understood that a small thickness is necessary because the microwave penetration capacity in food is low, on the order of 2 cm. It therefore is necessary to limit the base to this small height to obtain the greatest efficiency.

To increase the volume, it is suitable to vary the other dimensions.

The compensation zone is folded in FIG. 1A, but with an unfolding initiator so as to be able to distinguish the different parts. In reality, the height of the unit seems to be essentially the same as that of the height of the base.

This compensation zone comprises folds 22 and 24, respectively located on the faces opposite said retractable faces 26 and stiffening faces 28.

Retractable faces 26 each comprise a fold 30, obtained by grooving the cardboard-type material, whereby this fold is approximately in the center of each of the faces and parallel to the base.

Stiffening faces 28 each comprise several folds, a first fold 32 in the continuity of folds 30, placed in the median plane. In contrast, each fold 32 is also obtained by grooving, but comprises in the central portion a cutaway 34 that makes it possible to form a diamond-shaped window, with an opening that can vary during unfolding operations, as will be indicated below. Cutaway 34 is linear and optionally comprises additions to facilitate this opening. Advantageously, cutaway 34 can comprise at each end a cutaway 35 that extends in an approximately perpendicular manner to cutaway 34, on both sides of said cutaway 34 so as to prevent the box from tearing in the extension of cutaway 34.

In addition, 36 diagonal folds, also produced by grooving, are provided.

Thus obtained is a bellows with rigid, foldable walls.

Unfolding means 18 comprise two tabs 38, one per retractable face 26. As shown in FIG. 2, each tab is advantageously T-shaped. A slit 40 is located in each fold 30, whereby said slit has a length that allows the passage of the longitudinal branch 42 of the T and prevents the passage of transverse branch 44. In this embodiment that is presented, the assembly is simple and purely mechanical.

The transverse branch is optionally bonded directly to this retractable face 26, but on the outside.

The means 20 for opening/closing this container comprise two flaps 46, 48 that can be retracted and that are each provided with a clip 50, 52. Each clip can immobilize the opposite flap to ensure that flaps are locked in the closing position of the container.

The bottom of the container is formed, in a way known in box-making, by four flaps 54-60 being arranged alternately on top of one another.

To be certain that the corn kernels are well enclosed without the risk of passing through these flaps that are arranged alternately on top of one another, a tub 62, shown in FIG. 2, is provided.

This tub is also made of a material that absorbs the energy that is transported by the microwaves and that can generate infrared radiation that can trigger the Maillard reactions when these are kernels with sugars. In the case of corn kernels that are salted or buttered, no conversion occurs, but the energy that is absorbed improves the popping.

To preserve the corn kernels with the hygrometric degree necessary for popping thereof, generally on the order of 14%, it is necessary to place the device under a suitable complex film. This protective complex is opened at the time of use as for any other food product of this type.

The use of this device for the display and cooking of corn kernels to make popcorn therefrom is now indicated.

The consumer withdraws from its package the device, which is in folded form with corn kernels immobilized in the base, in tub 62, if present. The base makes it possible to store the kernels and to immobilize them in a restricted space. The presence of the base also makes it possible to obtain a complete folding of the compensation zone 16 contrary to the devices of the prior art. The consumer pulls on the two tabs 38 so as to remove the two retractable faces 26, at right angles with each fold 30, which has the effect of unfolding these two faces, removing the base 14 from closing means 20 and simultaneously unfolding the stiffening faces 28. The window 34 closes to no more than a slit, and these stiffening faces become essentially planar. The cutaway 34 that forms the window promotes the unfolding of the compensation zone 16 and reduces the deterioration of the edges connecting the faces 26 and 28. This cutaway 34 is even necessary when the faces 26 and 28 are trapezoidal to create a box shaped like an upside-down truncated pyramid.

The microwave oven is put into operation for the recommended period, which causes the popping of the corn kernels and the conversion of sugars.

The device is then filled with popcorn that is ready to eat.

The volume of the container is established based on the volume of kernels initially contained in the base.

The consumer can use tabs 38 to handle the device without being burned.

When he is ready, the consumer opens two flaps 46, 48 by removing two clips 50, 52 to dig into the interior.

It is noted that the container is stable, rigid and makes it possible not only to store it before use in a compact form and to cook it, but also to display it, without it being necessary to tear or cut a bag with the concomitant risks of spilling the entire contents.

An additional significant advantage that solves the problem of residual heat is that the slits located in the different faces make possible an evacuation of the steam and prevent the concentration of this residual heat.

It is also noted that it is possible to reclose the two flaps 46 and 48 to preserve the remaining popcorn for the purpose of later consumption.

Such a device is industrially advantageous for its simple production.

Actually, the device according to the invention is completely rigid by itself.

The folding, the filling and the packaging of the device according to this invention can be easily automated.

Cardboard was mentioned because it is a particularly suitable material, but it would be possible to use a synthesis material, one of the conditions being to exhibit a certain rigidity.

Likewise, the presented shape has constant dimensions in height, but the container can be shaped like an upside-down truncated pyramid.

According to an improved version, the flaps 46 and 48 can be made detachable with pre-scoring to ensure that it opens fully and freely.

In FIGS. 3, 4, 5, 6A, 6B, 7A and 7B, various embodiments of tub 62 are shown.

According to a first embodiment, the tub is obtained from a quadrilateral-shaped mold 64 that preferably consists of a paper- or cardboard-based multilayer structure that is coated with at least one metalized sheet 66, indicated by dashes, which can absorb the energy that is transported by microwaves.

The mold 64 comprises four folding lines 68, each parallel to an edge of the mold 64, delimiting flaps 70 that can form the side walls of the tub. Folding lines 68 delimit in the center the bottom of the tub whose dimensions are adapted to the base 14.

At the level of each angle, a folding line 72 is provided that connects each angle of the mold and the corresponding point of intersection of the folding lines 68 to allow the folding of the side walls of the tub. Preferably, excess thickness zones 74, produced by the folding of side walls at each angle, are retracted against the outside faces of said side walls, as illustrated in detail in FIG. 4, so as to form a trough that flows in the direction of the inside of tub 62 to limit the leakage of grease outside of said tub 62.

Preferably, as illustrated in FIG. 3, the metalized sheet 66 is placed between two parallel folding lines 68 to keep metalized zones from coming into contact at corners and to limit heating risks.

According to another characteristic of the invention, as illustrated by FIG. 5, the flaps 70 that form the side walls of the tub each comprise an extension 76 that can cover a portion or the entirety of the inside walls of the box 10 so as to reduce the risks of contact of the grease with the walls of said box 10.

According to another characteristic, the tub comprises an element that forms a cover to isolate the food products, either in the form of a film or in the form of a covering sheet 78 that is made of cardboard or a semi-rigid material and that is connected to the side walls of the small container 62 with a seam or glue that is preferably thermosetting, as illustrated in FIGS. 6A, 6B, 7A and 7B.

Advantageously, the covering sheet 78 is cross-shaped and comprises offsets 80 so as not to cover the angle zones of the mold 64 and to prevent excess thicknesses in this folding zone. The sheet 78 preferably comprises first folding lines 82 that are parallel to the folding lines 68, slightly offset toward the outside to facilitate the shaping of the tub 62.

The covering sheet 78 advantageously comprises second folding lines that make it possible to obtain a volume that can contain food products, as illustrated in FIG. 6B. The second folding lines make it possible to obtain a truncated pyramid shape and comprise folding lines that delimit a square 84 and diagonal folding lines 86 connecting each peak of said square to the angle of the corresponding offset 80.

According to another characteristic of the invention, illustrated by FIGS. 7A and 7B, the covering sheet 78 comprises third folding lines 88, not parallel to the first folding lines 82, forming a truncated triangle with one of the sides of the square 84. When the opposing sides of the tub 62 are pulled together, these folding lines 88 make it possible to create a pour funnel as illustrated in FIG. 7B.

Of course, the embodiment of FIGS. 6A and 6B can comprise extensions 76 as illustrated in FIG. 5 and/or a metalized sheet 66 as illustrated in FIG. 3.

In FIGS. 8A and 8B, another method for packaging food products was shown. This packaging method comprises a packet 90 that rests on a sheet 92, made of a material that is identical to that of mold 64, covering the bottom of the box. The packet 90 comprises seam lines, one 94 oriented upward, thermosetting at the temperature at which popcorn is cooked so that they open during cooking and flatten against the inside walls of the box to reduce the risk of the walls of said box 10 coming into contact with the grease, as illustrated in FIG. 8B.

In FIGS. 9A, 9B and 10, another variant of the first container 12 is shown. The elements that are identical to the preceding variant are referenced in the same manner.

According to this variant, the means 20 for opening/closing comprise two flaps 46, 48 that can be retracted, one 48 of them comprising a tab 96 that can pass through a slit 98 that is located on the other flap 46. On its free end, the tab 96 comprises a retracted edge 99. According to an embodiment, the tab 96 is obtained using two cutaways that extend over an adequate length from the free edge of the flap 48 that is opposite to the edge that is connected to the compensation zone 16. In addition, the slit 98 has suitable dimensions for allowing the tab to pass and is positioned close to the free edge of the flap 46 that is opposite to the edge that is connected to the compensation zone.

The operation of the means 20 for opening and for closing is as follows:

In the closed position, the tab 96 passes through the slit 98. During cooking, the volume of popcorn gradually increases until the flaps 46 and 48 are slightly raised. This movement is allowed and controlled by the tab 96 that slides into the slit 98 until the retracted edge 99 reaches—and is immobilized at—the slit 98. This slight raising of the flaps makes it possible to indicate the end of the cooking, which facilitates the use of the device of the invention.

It is possible to adjust the rising height based on, in particular, the length of the tab.

To be certain that the kernels of corn are stored well without the risk of passing through these flaps that are arranged alternately on top of one another and for packaging hermetically the kernels of corn and the optional other ingredients, a small container 62 that constitutes a second container that is placed at the base of the first container described above is provided. In the various FIGS. 11A to 21B, various embodiments of said small container are shown.

The small container 62 is produced from a mold that is cut out in a complex that comprises at least two sheets placed side by side, one made of rigid paper or cardboard, the other made of plastic that ensures the sealing, such as, for example, polyethylene.

Advantageously, the complex comprises, at the level of at least one zone, a layer made of a material that absorbs the electro-magnetic waves called a susceptor.

According to the invention, the small container 62 is made from a mold that comprises a first part that forms a container that can accommodate the kernels of corn and the possible other ingredients and at least a second part that forms a pivoting cover that is connected to the first part, on the one hand, by at least one folding line that forms a joint, and, on the other hand, by a thermosetting bond so as to form a sealed chamber in a first state called a closed state and to allow the pivoting of the cover so as to allow the expansion of the popcorn in a second state called an open state, after the thermosetting bond is broken when the temperature exceeds a certain threshold.

This arrangement makes it possible to obtain a sealed chamber that ensures a better preservation of the products. Furthermore, the fact of providing at least one pivoting cover that is always connected to the container and that is flattened against the walls of the compensation zone 16 in the open state makes it possible to increase the safety, whereby the user no longer has to remove a hot element such as a film. Finally, this arrangement makes it possible to obtain a more appetizing product, no element to be removed being mixed with the popcorn any longer in the manner of a film of the prior art.

Preferably, the small container 62 is placed in the first container so that said pivoting cover is flattened against one of the stiffening faces 28.

The cover optionally can be detached from the remainder of the small container 62 using a precut line.

In FIGS. 11A, 11B and 11C, a first embodiment of a small container 62.1 is shown.

In this case, the referenced container 100 comprises a square or rectangular bottom 102 and four side walls 104 that are connected to the four sides of the bottom 102 via folding lines, whereby the side walls 104 are connected two by two by bellows 106 that participate in the sealing of the small container.

The small container 62.1 comprises two pivoting covers 108, 108' that are connected by folding lines 110 to opposite side walls 104.

Each pivoting cover 108, 108' comprises a first flap 112 at a first lateral edge and a second flap 114 at a second edge (opposite to the first edge), whereby the flaps are hinged relative to the remainder of the cover using folding lines 116.

To form the small container, in a first step the container is produced by folding the side walls 104 and the bellows 106 as illustrated in FIG. 11B. Then, as illustrated in this same figure, a first cover 108 is retracted in closed position, whereby the flaps 112 and 114 are bonded—using a thermosetting bond—to the outside faces of the side walls 104 to obtain a container as illustrated in FIG. 11C.

Next, the container is filled in a vertical position. After filling, the second pivoting cover 108' is retracted in closed position, whereby the flaps 112 and 114 are bonded using a thermosetting bond on the outside surfaces of the side walls 104. To obtain a sealed bond between the covers, the inside surface of the free edge 118' of the cover 108' is linked—using a thermosetting bond—to the outside surface of the free edge 118 of the cover 108.

FIGS. 12A to 12C illustrate a second embodiment of a small container 62.2.

In this case, relative to the first embodiment, the flaps are borne by the side walls of the container.

There is a container 100 with a bottom 102, side walls 104 and bellows 106. The small container 62.2 also comprises two covers 108 and 108' that are connected by folding lines 110 to opposite side walls 104.

The side walls 104 that do not bear the covers are extended by the flaps 112 and 114 that are hinged relative to the side walls using folding lines 116.

As above, this embodiment allows a filling in vertical position.

Furthermore, to ensure the sealing, the inside face of the free edge 118' of the cover 108' is linked using a thermosetting bond to the outside face of the free edge 118 of the cover 108.

The first two embodiments may each have a variant in which the small container comprises only a single cover that covers the entire container, connected to a single side wall, whereby the flaps are provided on the three free edges of the cover or at the level of the three side walls that do not bear the cover.

FIGS. 13A and 13B illustrate a third embodiment of a small container 62.3 that is very close to the second embodiment. The identical elements are referenced in the same manner.

In addition to the second embodiment, in this case, a first series of folds 120 are connected to the covers 108 and 108' at each angle that is formed by the covers and the bellows. Once the cover is retracted, these folds are bonded using a thermosetting bond against the outside face of the side walls. In addition or as substitution, a second series of folds 122 is connected to the flaps 112 and 114 at each angle formed by the flaps and the bellows, whereby said folds 122 are placed between the bellows and the side walls.

These series of folds 120 and 122 contribute to improving the sealing at the upper angles of the small container.

In FIGS. 14A, 14B, 15A, 15B, 15C, 16, 17A, 17B, 17C, 17D, 18, 19A and 19B, 20, 21A and 21B, variants are shown that offer the advantage of bonding the coated faces with the same material, namely bonding the faces that are coated by plastic with the faces that are coated by plastic.

This solution contributes to simplifying the bonding or the welding and increases significantly the sealing that is reflected by a longer preservation period.

Thus, in FIGS. 14A and 14B, a fourth embodiment of a small container 62.4 is shown.

This small container comprises a container 200 with a square or rectangular bottom 202 and four side walls 204 that are connected to the four sides of the bottom 202 via folding lines, whereby the side walls 204 are connected two by two by bellows 206 that participate in the sealing of the small container.

It also comprises a pivoting cover 208 that is connected by a folding line 210 to one of the side walls 204.

At its free edges, this pivoting cover 208 comprises flaps 212.1, 212.2 and 212.3 that are able to work respectively with flaps 214.1, 214.2, and 214.3 that are connected by the folding lines 216 to the side walls. The flaps are connected two by two by a thermosetting bond to allow the opening of the small container during the cooking.

Advantageously, the flap 214.2 that is used at the side wall opposite to the one that supports the cover comprises folds 218 on each side, and said folds can be bonded against the adjacent flaps 214.1 and 214.2.

In the other FIGS. 15A, 15B, 15C, 16, 17A, 17B, 17C, 17D, 18, 19A and 19B, variants are shown whose advantage is to provide surfaces for bonding or welding the cover in the same plane and one or more flat cover(s) that make it possible to simplify this operation and to increase the quality of the sealing that is thus obtained.

In FIGS. 15A, 15B and 15C, a fifth embodiment of a small container 62.5 is shown.

There is a container 200 with a bottom 202, side walls 204 and bellows 206. Contrary to the preceding embodiments, the bellows are folded toward the outside of the container.

This small container also comprises a cover 208 that is connected via a folding line 210 to one of the side walls 204 and optionally to the bellows 206 that are adjacent to said wall 204. The cover has a width that extends beyond the side wall, essentially equally to that of the side wall and two adjacent bellows.

In addition, the small container 62.5 comprises flaps 212 that are connected by a folding line 214 to the side walls that are not connected to the cover 208 and that are not retracted against the outside face of the side walls as for the fourth embodiment but folded essentially 90° relative to said side walls toward the outside and are placed in the same plane that is essentially parallel to the bottom 202. To facilitate the shaping of the container 200 and flaps 212, bellows 216 are provided that each have a common side with a first bellows 206 and a flap 212.

As illustrated in FIG. 15C, these bellows 216 are formed above flaps 212, and are then retracted on the flaps so as to connect the flaps 212 to one another.

The use of this small container is as follows:

In a first step, the container 200 is formed by bonding or welding the bellows 206. This welding or bonding is preferably resistant to heat and is not thermosetting. Following this operation, the side walls are straightened. Next, the flaps 212 are folded 90°, and the bellows 216 are formed, as illustrated in FIG. 15C. They are then retracted and bonded or welded onto the flaps 212. As above, this welding or bonding is preferably heat-resistant and is not thermosetting.

After filling the container, operated horizontally, the cover is closed by bonding it or by welding it in a thermosetting manner against the flaps 212.

According to this embodiment, it is noted that the flaps 212 participate in the wedging of the small container 62.5 in the first container. As indicated above, the small container is positioned in the first container so that the cover is flattened against a stiffening face 26 in open position. Advantageously, the flaps 212 that are placed against the retractable faces 28 have suitable shapes and are in particular broader to immobilize the small container well and to follow the shapes of said faces 28 that have a tendency to curve toward the outside.

According to an improvement, it is possible to provide, at the level of the angles, a third bellows 218 that is formed and folded under the flaps 212. This flap makes it possible to reduce the risks of leakage.

In FIG. 16, a sixth embodiment of a small container 62.6 that is very close to the fifth embodiment comprising two covers 208 is shown. The elements that are identical to the fifth embodiment bear the same references.

In FIGS. 17A to 17D, a seventh embodiment that allows a filling in vertical position of a small container 62.7 is shown.

This small container 62.7 has a container 300 and a cover 302 that are connected to one another by a junction zone 304 that comprises the pivoting axis of the cover relative to the container.

The container 300 and the cover 302 have symmetrical shapes relative to the junction zone 304.

Thus, each of them has a square or rectangular shape, with a first centered square or rectangular folding line 306, and second folding lines 308 that connect the tips of the first folding line 306 to the angles of the cover or the container. These folding lines make it possible to obtain a truncated pyramid.

Two third folding lines 310 are provided, symmetrical relative to the median axis that is perpendicular to the pivoting axis of the cover, whereby said lines extend from the tips of the first folding line 306 that is close to the junction zone and tends to join it.

In addition, the edges of the container that are not connected to the junction zone 304 are welded or bonded to the corresponding edges of the cover using a thermosetting bond that can be broken during cooking.

According to an embodiment, the junction zone 304 can be limited to a folding line or, as illustrated in the figures, to two first contiguous flaps 312 that are bonded or welded against one another, whereby preferably this bond is not thermosetting.

To ensure better stability, the small container 62.7 comprises—at the level of the edges of the container—second flaps 314 that are connected between one another or to one of the first flaps 312 by bellows 316. These flaps are folded 90° and are kept in this position using bellows 316 that are formed and bonded or welded against the outside face of the flaps as illustrated in FIG. 17D.

This embodiment is used in the following manner:

In a first step, the flaps 312 are bonded one against the other, and then two opposite edges of the container and the cover are bonded or welded.

To fill the small container, the junction zone is arranged downward and the edges of the container and the cover that is not bonded or welded are oriented upward. By pushing the edges that are opposite and that are bonded with the container and the cover toward one another, as illustrated in FIG. 17B, an opening 318 is produced. The third folding lines 310 contribute to the formation of this opening that promotes the filling in vertical position.

After filling, the third edges of the container and the cover are bonded or welded so as to obtain a small sealed container as illustrated in FIG. 17C. The folding lines 306 and 308 make it possible to obtain a volumetric form.

Then, the flaps 312 and 314 are folded 90°, and the bellows 316 are bonded or welded so as to keep them in this folded position, as illustrated in FIG. 17D.

This embodiment makes it possible to obtain a vertical filling to simplify the welding or bonding phase of the container and the cover.

In FIGS. 18, 19A and 19B, an eighth embodiment that makes possible filling in horizontal position of a small container 62.8 is shown.

This small container is close to the embodiment that is illustrated in 15A, 15B, and 15C, whereby the identical elements are referenced in the same manner.

According to this embodiment, the cover 208 is bonded to the container along its entire perimeter. Thus, the four sides of the cover are bonded against the flaps 212 and a flap 220 that is inserted between a side wall 204 and the cover 208. This solution makes it possible to obtain essentially the same resistance to the opening for the entire perimeter of the cover.

According to another improvement, at the side opposite to that from which said cover 208 is connected to the remainder of the small container, the cover 208 comprises a projecting portion 222 that may or may not extend over the entire length of said side so as to keep the cover 208 in closed position and to slow down its opening so as to obtain a sudden and quick complete opening. This configuration makes it possible to limit the risk of seeing popcorn be placed between the cover 208 and the wall of the first container so as to prevent the complete opening of said cover, which could cause overcooking of some kernels.

In FIG. 19A, the small container is shown in closed position. It is noted that the side of the cover 208, close to its joint with the remainder of the small container, is also bonded.

In FIG. 19B, the small container is shown in open position in a first container. It is noted that the cover is flattened against one of the walls of said first container with dimensions suitable to said container in particular in height so that the free end of the cover is close to the upper portion of the first container to limit the risk of seeing a popcorn kernel interposed between the cover and the side wall of said first container.

In this context, the small containers that comprise a single cover are preferred relative to those that comprise two covers because said covers are higher, which limits the risk of seeing a popcorn kernel jump above said cover and become interposed between said cover and the side wall of the first container.

The cover 208 can comprise folds at the lateral edges. Advantageously, these folds are made of two independent parts, whose shapes are adapted to the first container to limit the risk of seeing a popcorn kernel become interposed between said cover and the side wall of the first container. According to another improvement, the flaps 212 are broadened to rise along the side walls of the first container, as illustrated in FIG. 19B.

In FIGS. 20, 21A and 21B, a ninth embodiment that allows a filling in vertical position of a small container 62.9 is shown.

This small container comprises a container 400 with a square or rectangular bottom 402, and four side walls 404 connected to the four sides of the bottom 402 by folding lines, whereby the side walls 404 are connected two by two by bellows 406 that participate in the sealing of the small container.

When the side walls 404 are placed vertically, the bellows 406 are formed on the outside of the container and then retracted on the outside face of the walls so as to keep them perpendicular to the bottom 402.

This small container also comprises a cover 408 that is connected via a folding line 410 to one of the side walls 404.

According to this embodiment, the cover 408 comprises a central portion 420 whose dimensions are essentially identical to those of the bottom 402 and four flaps 422, one at the level of each side, each being able to work with a side wall 404. Advantageously, the flaps 422 are connected two by two at angles via bellows 424. According to this embodiment, the flaps 422 are bonded at the upper edge of the side walls 404 so that said flaps are folded 90° and oriented upward relative to the central portion 420, whereby the latter is offset downward relative to the upper end of the side walls 404.

In closed position, the bellows 424 are clamped between the two portions of the bellows 406 to ensure good sealing.

In practice, the cover 408 is closed on three sides, whereby only the flap 422 that is opposite to the junction line 410 is not bonded. The filling of the small container is carried out in vertical position. At the end of the filling, the last flap 422 is bonded to the corresponding side wall 404.

To bond or weld the elements, it is possible to use a related element such as a glue that may or may not be thermosetting according to the requirements, or any related element, whereby the plastic surfaces of the complex that is used to form the small container are heated and then flattened against one another in the connecting zones.

To obtain a definitive welding or a thermosetting welding that breaks during cooking, the rise in temperature is adjusted during the welding. By way of example, for a complex with a PET or polyethylene terephthalate surface, an elevation that is greater than or equal to approximately 270° C. is achieved to obtain a non-reversible welding and a temperature rise on the order of 180° C. to obtain a reversible welding and to obtain a thermosetting bond.

Regarding the complex, the latter comprises a layer made of material that absorbs the electromagnetic waves at the bottom of the small container alone.

In FIGS. 22 to 27, another variant of the invention has been shown. As above, this device 500 comprises a container with a base 502, a compensation zone 504, means 506 for unfolding, and means 508 for opening/closing this container.

The base 502 and the means 508 for opening/closing are essentially identical to those of the variant that is illustrated in FIGS. 1A and 1B.

As above, the compensation zone 504 comprises four faces: two opposite retractable faces 510 and two opposite stiffening faces 512.

The retractable faces 510 each comprise a fold 514, obtained by making grooves in the cardboard-type material, whereby this fold is approximately in the center of each of the faces and parallel to the base 502.

The stiffening faces 512 each comprise several folds, a first fold 516 in the continuity of the folds 514, arranged in the median plane. In contrast, each fold 516 is also obtained by making grooves but comprises a cutaway in the central part that makes it possible to form a diamond-shaped window, with an opening that can vary during unfolding operations, like the variant illustrated in FIGS. 1A and 1B.

In addition, diagonal folds 518, also obtained by making grooves, are provided.

An accordion with foldable rigid walls, as illustrated in FIG. 23, is thus obtained.

Advantageously, the opening/closing means 508 comprise at least two flaps 530 that are hinged relative to the retractable faces using folding lines.

According to this variant, at least one retractable face 510 comprises cutaways 520 that are oblong in shape, parallel to one another, making it possible to see the interior of the container and to thereby monitor the cooking of the popcorn.

The cutaways 520 have a suitable width, on the order of 7 mm, for preventing the popcorn from exiting.

The cutaways 520 have a length that is slightly less than the distance that separates the upper edge of the retractable face and the folding line 514. Preferably, the two retractable faces 510 comprise cutaways 520.

According to one embodiment, the unfolding means 506 comprise, for each retractable face, a handle that is cut out in the corresponding retractable face.

To obtain each handle, each retractable face 510 comprises two cutting lines 522, parallel to one another, spaced on the order of 10 mm or less, extending from the folding line 514 in the direction of the upper edge of the retractable face that forms a tab 524. These cutting lines 522 are arranged essentially symmetrically relative to the vertical median axis of the retractable faces.

In the upper part, a pre-scoring 526 connects the cutting lines 522 and delimits a disk shape 528 astride the retractable face 510 and the flap 530 that forms a part of the opening/closing means.

According to this variant, each handle comprises a tab 524 that comprises a disk 528 on its end, whereby said tab and said disk are obtained from cutaways and from a pre-scoring made in the wall of the retractable faces 510 and flaps 530.

In the folded state, as illustrated in FIG. 22, for each handle, the disk 528 is folded in two so as to obtain two half-disks that are flattened against one another and is able to be clamped by an operator.

To unfold the device, the operator, with his two hands, clamps the two handles at the two disks 528 that are folded in two on each side of the device and exerts a force that tends to separate the handles, as illustrated in FIG. 23. Thus, the pre-scoring 526 that delimits the disks 528 are cut, making it possible to separate the ends of the two handles from the retractable faces as illustrated in FIG. 24.

The folding line 514 then forms a hinge of the handles relative to the remainder of the device.

By continuing to pull on the handles, the operator causes the complete unfolding of the device as illustrated in FIG. 24.

This embodiment makes it possible to simplify the production to the extent that the handles are cut out in the mold that forms the device, the unit forming an integral element.

The position of the disks astride the retractable faces and the flaps makes it possible to obtain two half-disks that are flattened against one another and that are simple to grip and to detach.

Advantageously, as illustrated in FIG. 27, a small sauce container 550 can be added at the upper opening of the device when the popcorn is cooked.

This small sauce container 550, presented in detail in FIGS. 25 and 26, comprises a recessed shape 552 with a triangular section that can store the sauce, with a bottom 554 and side walls 556 that extend into the upper part by a peripheral flange 558 that extends toward the outside of the recessed shape 552 perpendicular to the side walls 556. A detachable lid 560 that is bonded to the upper face of the peripheral flange 558 is provided to close the recessed shape 552 in an airtight manner.

To attach the small sauce container 550, the side walls 556 are arranged so as to form a right triangle with two perpendicular side walls 556-1 and 556-2.

In addition, the lower face of the peripheral flange comprises—opposite each side wall 556-1 and 556-2—at least one lug 562 that comprises a face that is spaced from the corresponding side wall 556-1 or 556-2 by a small distance that is slightly greater than the thickness of the walls of the device.

Preferably, the small sauce container comprises two lugs 562 opposite each side wall 556-1 and 556-2.

Advantageously, the side walls 556-1 and 556-2 comprise a release 564 to the right of each lug 562 so as to obtain a wedging of the end of the retractable or stiffening faces of the device between the two lugs 62 and the side wall 556-1 or 556-2 of the small sauce container.

The invention claimed is:

1. A device for the display and cooking of food products, in particular kernels of corn for making popcorn, comprising:

a container with a base that stores kernels of corn extended by a compensation zone having at least two positions, one folded and an other unfolded, wherein said compensation zone comprises four faces:

two retractable faces opposite two stiffening faces, the retractable faces each comprise a fold that is approximately at a center of each of these faces and parallel to the base and wherein the stiffening faces each comprise a first fold that is approximately at the center of each of these faces and parallel to the base and diagonal folds, wherein said base is rigid over a height so as to delimit a restricted space where the kernels of corn are stored upon the compensation zone being in the folded position, wherein said device comprises handles at each retractable face to unfold the container and at an upper part hinged flaps relative to the retractable faces, wherein each retractable face comprises a tab of a handle delimited by two cutting lines, the two cutting lines parallel to one and other, the two cutting lines spaced 10 mm apart or less, wherein each the tab comprises, at an end and a disk, wherein said tab and said disk are obtained from at least one of cutaways and a pre-scoring carried out in a wall of the retractable face and an adjacent flap, wherein said disk is astride said retractable face and said flap is folded in two to obtain two portions of disks that are flattened against one another and clamped by an operator when the device is in a folded state.

2. The device for the display and cooking of food products according to claim 1, wherein at least one retractable face comprises cutaways that are oblong in shape, parallel to one another, providing a view of an interior of the container.

3. The device for the display and cooking of food products according to claim 2, wherein the cutaways have a length that is slightly less than a distance that separates an upper edge of the retractable face and a folding line.

4. The device for the display and cooking of food products according to claim 1, wherein it comprises a small sauce container.

5. The device for the display and cooking of food products according to claim 4, wherein the small sauce container comprises a recessed shape with a triangular section that stores the sauce, with a bottom, side walls that are arranged to form a right triangle with two perpendicular side walls, a peripheral flange that extends toward the outside of the recessed shape perpendicularly to the side walls, wherein the lower face of the peripheral flange comprises at least one lug opposite each side wall and comprising a face spaced from a corresponding side wall by a small distance that is slightly greater than the thickness of the walls of the device.

6. The device for the display and cooking of food products according to claim 5, wherein the small sauce container comprises two lugs opposite each lateral wall.

7. The device for the display and cooking of food products according to claim 6, wherein the side walls comprise a release to the right of each lug so as to obtain a wedging of the end of the retractable or stiffening faces of the device.

* * * * *